US012392093B2

(12) United States Patent
Fukumoto et al.

(10) Patent No.: US 12,392,093 B2
(45) Date of Patent: Aug. 19, 2025

(54) MULTILAYER PRECAST PAVED ROAD

(71) Applicant: OBAYASHI ROAD CORPORATION, Tokyo (JP)

(72) Inventors: Katsuji Fukumoto, Tokyo (JP); Shuhei Mitsutani, Tokyo (JP); Masanori Sato, Tokyo (JP); Yosuke Matsushita, Tokyo (JP); Shiori Nakasai, Tokyo (JP); Tatsunori Mitsuda, Osaka (JP)

(73) Assignee: OBAYASHI ROAD CORPORATION, Tokyo (JP)

( * ) Notice: Subject to any disclaimer, the term of this patent is extended or adjusted under 35 U.S.C. 154(b) by 993 days.

(21) Appl. No.: 17/429,684

(22) PCT Filed: Jan. 8, 2020

(86) PCT No.: PCT/JP2020/000261
§ 371 (c)(1),
(2) Date: Aug. 10, 2021

(87) PCT Pub. No.: WO2020/194987
PCT Pub. Date: Oct. 1, 2020

(65) Prior Publication Data

US 2022/0205187 A1 Jun. 30, 2022

(30) Foreign Application Priority Data

Mar. 28, 2019 (JP) ..... 2019-063082

(51) Int. Cl.
*E01C 5/00* (2006.01)

(52) U.S. Cl.
CPC ..... *E01C 5/00* (2013.01)

(58) Field of Classification Search
CPC ..... E01C 5/005
See application file for complete search history.

(56) References Cited

U.S. PATENT DOCUMENTS 340,153 A * 4/1886 Pimm ..... E01C 5/005 404/40
1,411,415 A * 4/1922 Cooley ..... E01C 5/06 404/40

(Continued)

FOREIGN PATENT DOCUMENTS

DE 202018004468 U1 * 12/2018
GB 218666 A 3/1925

(Continued)

OTHER PUBLICATIONS

Extended (Supplementary) European Search Report dated Oct. 7, 2022, issued in counterpart EP application No. 20776392.1. (7 pages).

(Continued)

*Primary Examiner* — Christopher J Sebesta
*Assistant Examiner* — Katherine J Chu
(74) *Attorney, Agent, or Firm* — WHDA, LLP

(57) ABSTRACT

Provided is a multilayer precast paved road that enables simple coupling between upper pavement panels and lower pavement panels using joint members and enables easy and quick assembly and removal without requiring a large number of processes. A multilayer precast paved road including a plurality of precast lower pavement panels laid on a road panel and a plurality of precast upper pavement panels laid on upper surfaces of the lower pavement panels is configured such that the lower pavement panels 3 and the upper pavement panels are arranged in a zigzag manner, and joint members are provided to lie between upper and lower joining surfaces of the lower pavement panels and the upper pavement panels, and the lower pavement panels and the upper pavement panels are coupled to each other through engagement or fitting between the lower pavement panels (Continued)

and the upper pavement panels achieved by the joint members.

6 Claims, 19 Drawing Sheets

(56) References Cited

U.S. PATENT DOCUMENTS

| | | | | | |
|---|---|---|---|---|---|
| 2,282,335 | A * | 5/1942 | Methven | E01C 23/021 | 404/48 |
| 2,508,443 | A * | 5/1950 | Carter | E01C 11/106 | 404/60 |
| 2,700,329 | A * | 1/1955 | Carter | E01C 11/14 | 404/49 |
| 4,488,833 | A * | 12/1984 | Perry | E01D 15/22 | 14/27 |
| 4,522,531 | A * | 6/1985 | Thomsen | E01C 11/14 | 404/49 |
| 5,664,899 | A * | 9/1997 | Eustis | F16B 12/14 | 403/268 |
| 5,816,738 | A * | 10/1998 | Harnapp | E04F 15/105 | 404/34 |
| 6,547,477 | B1 * | 4/2003 | Huber | F16B 12/2009 | 403/231 |
| 9,206,596 | B1 * | 12/2015 | Robinson | E04B 1/948 | |
| 10,794,055 | B1 * | 10/2020 | Robinson | E04B 1/61 | |
| 11,766,947 | B2 * | 9/2023 | Pathipati | B60L 53/12 | 320/109 |
| 2006/0182496 | A1 * | 8/2006 | Shaw | E01C 11/14 | 404/56 |
| 2013/0326966 | A1 * | 12/2013 | Willems | E01C 11/225 | 52/125.4 |
| 2015/0151914 | A1 * | 6/2015 | Boulton | B65G 5/00 | 210/170.03 |
| 2016/0355997 | A1 * | 12/2016 | Lewley | H05B 3/56 | |
| 2019/0084434 | A1 * | 3/2019 | Yoshizaki | B60L 53/60 | |

FOREIGN PATENT DOCUMENTS

| | | | | | |
|---|---|---|---|---|---|
| JP | 63-7402 | A | | 1/1988 | |
| JP | 6-53606 | U | | 7/1994 | |
| JP | H0653606 | U | * | 7/1994 | |
| JP | 8-326007 | A | | 12/1996 | |
| JP | 9-316805 | A | | 12/1997 | |
| JP | 10-325102 | A | | 12/1998 | |
| KR | 20090001058 | U | * | 2/2009 | |
| KR | 10-2013-0050445 | A | | 5/2013 | |
| KR | 20130050445 | A | * | 5/2013 | |
| WO | WO-02086240 | A1 | * | 10/2002 | E01C 5/005 |

OTHER PUBLICATIONS

Office Action dated Jun. 29, 2023, issued in Counterpart CA Application No. 3,132,794. (3 pages).

Requisition by the Examiner (Examiner's report) dated Dec. 2, 2022, issued in counterpart CA application No. 3132794. (3 pages).

International Search Report dated Mar. 24, 2020, issued in counterpart International Application No. PCT/JP2020/000261 (3 pages).

Office Action dated Feb. 7, 2023, issued in counterpart JP Application No. 2020-500908, with English translation. (6 pages).

* cited by examiner

MULTILAYER PRECAST PAVED ROAD

TECHNICAL FIELD

The present invention relates to a multilayer precast paved road.

BACKGROUND ART

Paved roads in the related art are produced by pavement materials, such as hot asphalt mixtures and ready-mixed concrete, being spread using paving machines dedicated for the hot asphalt mixtures and the read-mixed concrete, rolled as needed, and then cured and hardened.

Degradation of paved roads advances with time after being placed in service, and after advancement of degradation, it is necessary to regulate traffics, to take off not only degraded parts but also pavement materials in wider ranges using dedicated machines such as backhoes and breakers, and to reconstruct paved roads with new pavement materials.

However, construction including repairing of paved roads has problems as follows. First, insufficient curing of pavement materials occurs when it rains, and it is thus not possible to carry out construction. Also, the pavement materials can be used in limited times after preparation, and it is thus difficult to make plans including preparation timings and delivery timings of the pavement materials. Moreover, big noise occurs and bothers neighbors when the pavement materials are taken off for repairing and the like, and construction time slots are also limited.

Meanwhile, a temporary road for a site of civil engineering work adapted such that laying members with appearances like precast pavement panels are formed by filling casings made of steel or FRP with styrene foam, the laying members are disposed on a road panel with upper laying members and lower laying members arranged in a zigzag manner, and the upper laying members and the lower laying members are fastened in the up-down direction with fastening tools such as bolts and nuts has been proposed as a road that does not use known pavement materials (see Patent Literature 1, for example).

However, since the aforementioned temporary road has a structure in which box-shaped elements made of steel or FRP are filled with styrene foam, it is not possible to use the temporary road for an ordinary road or a highway in practice in terms of strength even if a reinforcing structures are added to the inside. Further, since coupling between the upper laying members and the lower laying members is achieved through fastening using bolts and nuts, a large number of processes are needed both for assembly and for removal. In addition, fastening using bolts and nuts is easily loosened due to vibration, and is thus not suitable for an ordinary road at any rate where vehicles frequently travel, much less for applying to a highway.

CITATION LIST

Patent Literature

Patent Literature 1: Japanese Patent Laid-Open No. 8-326007

SUMMARY OF INVENTION

Technical Problem

Thus, an object of the present invention is to provide a multilayer precast paved road that enables simple coupling between upper pavement panels and lower pavement panels using joint members and enables easy and quick assembly and removal without requiring a large number of processes without causing any unevenness.

Solution to Problem

In order to achieve the aforementioned object, the present invention provides a multilayer precast paved road including: a plurality of precast lower pavement panels laid on a road panel; and a plurality of precast upper pavement panels laid on upper surfaces of the lower pavement panels, the multilayer precast paved road being configured such that the lower pavement panels and the upper pavement panels are arranged in a zigzag manner, and joint members are provided to lie between upper and lower joining surfaces of the lower pavement panels and the upper pavement panels, and the lower pavement panels and the upper pavement panels are coupled to each other through engagement or fitting between the lower pavement panels and the upper pavement panels achieved by the joint members.

Advantageous Effects of Invention

According to the present invention, an advantage can be achieved that it is possible to simply couple the upper pavement panels to the lower pavement panels using the joint members and to easily and quickly perform assembly and removal without requiring a large number of processes without causing any unevenness in the multilayer precast paved road.

DESCRIPTION OF EMBODIMENTS

Hereinafter, embodiments of the present invention will be described based on the accompanying drawings.

[Multilayer Precast Paved Road]

First Embodiment

Figure 1:
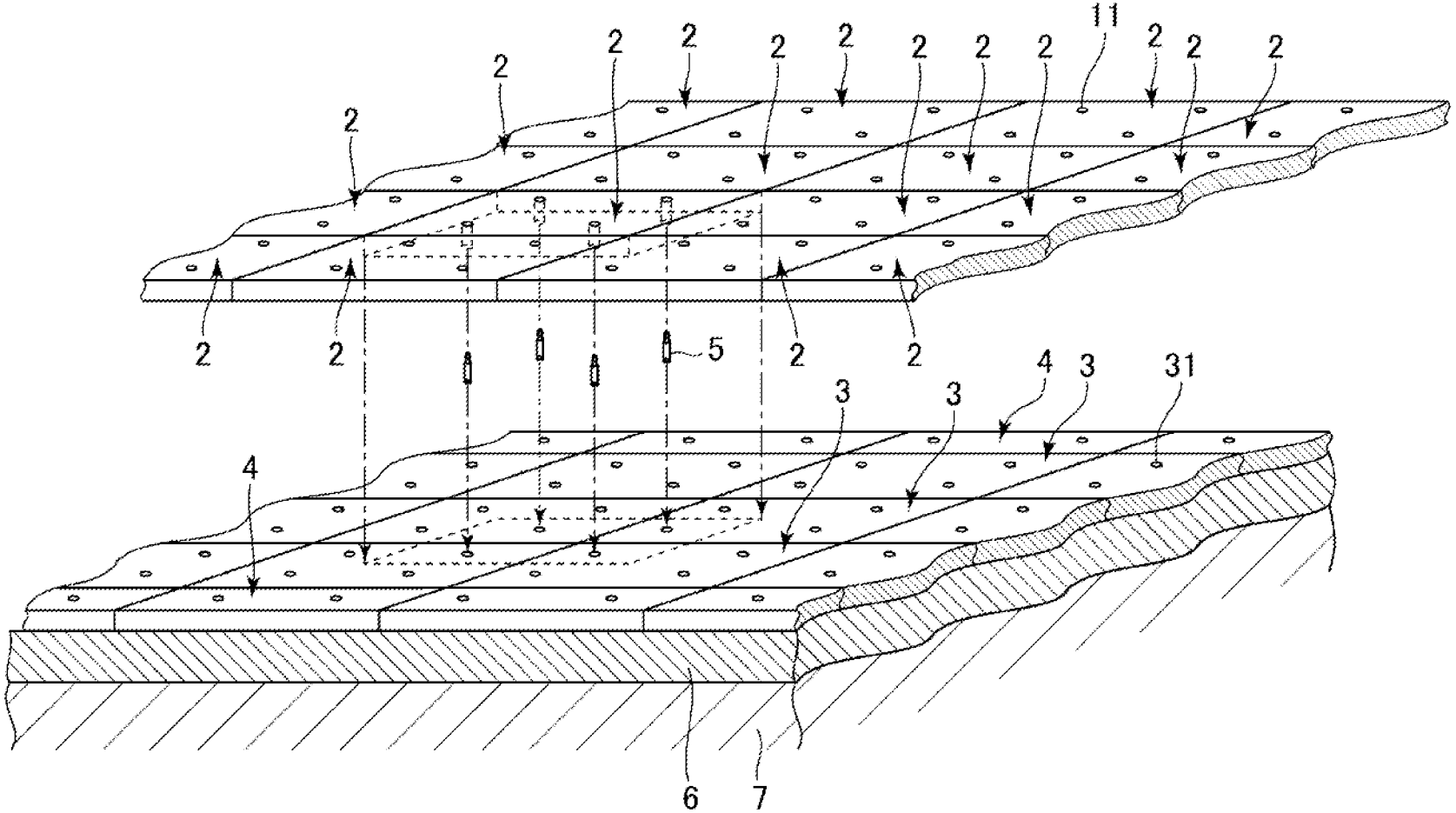
FIG. 1 is an exploded partial perspective view for explaining a configuration of a multilayer precast paved road according to a first embodiment of the present invention.

FIG. 1 is an exploded partial perspective view for explaining a configuration of a precast paved road according to a first embodiment of the present invention, and the illustrated multilayer precast paved road includes a plurality of lower pavement panels 3 and end portion lower pavement panels 4 with rectangular plate shapes that are precast pavement panels configured to be laid on a road panel 6 provided on a roadbed 7 and a plurality of upper pavement panels 2 with rectangular plate shapes that are precast pavement panels configured to be placed on tops of the lower pavement panels 3 and the end portion lower pavement panels 4 paved in this manner. Here, the plurality of upper pavement panels 2 are arranged in a zigzag manner with respect to the plurality of lower pavement panels 3 and the end portion lower pavement panels 4, and the upper pavement panels 2 are coupled (fastened) to the lower pavement panels 3 and the end portion lower pavement panels 4 with a plurality of joint members 5 in the up-down direction.

The upper pavement panels 2, the lower pavement panels 3, and the end portion lower pavement panels 4 used in the present invention are molded in advance by a known precast method before construction of the multilayer precast paved road according to the present invention. Note that for construction of curved parts, pavement, panels with taper-shaped front and back end surfaces in a traveling direction (front-back direction) or auxiliary pavement panels with front and back end surfaces formed into substantially wedge shapes, which are not illustrated, may be used in addition to the aforementioned pavement panels with rectangular plate shapes. The pavement panels with rectangular plate shapes and the pavement panels with tapered surfaces are connected to each other with bolts or dowel pins at joint parts. Also, in a case where the road panel 6 includes irregularity, loose sand is sprinkled to level the irregularity. However, according to the present invention, it is possible to carry in an irregularity leveling material of an asphalt sheet wound into a roll shape, for example, and to deploy and lay the irregularity leveling material at the irregular part of the road panel 6.

Incidentally, the multilayer precast paved road according to the present invention is adapted such that each upper pavement panel 2 is coupled (fastened) to lie between adjacent lower pavement panels 3 and 3 from among the paved lower pavement panels 3 in a basic form. Therefore, in the example illustrated in FIG. 1, a multilayer precast paved road with a specific width is constructed by four upper pavement panels 2 being placed on and coupled (fastened) to the tops of the same number of lower pavement panels 3 and the same number of end portion lower pavement panels 4 on the upper and lower sides in a zigzag manner. Note that the road width changes in accordance with a line shape, and vehicle traveling positions that form trajectories do not necessarily conform to the road line shape. Therefore, in a case where a remnant occurs on the side of the upper pavement panels 2 due to dimensional differences of the upper and lower pavement panels 2 to 4 depending on a change in road width, and a vehicle traveling position that does not conform to the line shape, and the like even if one upper pavement panel 2 can be laid so as to lie between two panels, namely the lower pavement panel 3 and the end portion lower pavement panel 4 in the zigzag arrangement or at an end portion of the upper pavement panels 2, the lower pavement panels 3, and the end portion lower pavement panels 4, it is possible to adjust an upper pavement panel 2 for a remnant and to use the upper pavement panel 2 to adjust the lower pavement panel 3 and the end portion lower pavement panel 4 for the aforementioned remnant.

Note that "arranged in a zigzag manner" in the present embodiment means that the upper pavement panels 2, the lower pavement panels 3, and the end portion lower pavement panels 4 are arranged with mutual connecting parts (joints) deviating from each other such that connecting parts (joints) of the upper pavement panels 2 laid on tops of the lower pavement panels 3 and the end portion lower pavement panels 4 do not overlap connecting parts (joints) of the lower pavement panels 3 and the end portion lower pavement panels 4 laid in the lower layer.

Incidentally, although upper pavement panels 2, the lower pavement panels 3, and the end portion lower pavement panels 4 with rectangular shapes having the same planar shapes and the same sizes are used in the multilayer precast paved road illustrated as an example in FIG. 1, it is also possible to use pavement panels with different sizes for the upper layer and the lower layer. Also, although four upper pavement panels 2 are laid on tops of the four panels, namely the lower pavement panels 3 and the end portion lower pavement panels 4 laid in the road width direction in the example illustrated in FIG. 1, there are various forms in which the upper pavement panels 2, the lower pavement panels 3, and the end portion lower pavement panels 4 are arranged such that each upper pavement panel 2 lies between two lower pavement panels 3 in the multilayer precast paved road according to the present invention.

Note that although the upper pavement panels 2, the lower pavement panels 3, and the end portion lower pavement panels 4 used in the multilayer precast paved road according to the present embodiment have, as basic shapes, rectangular or quadrangular shapes in a plan view, it is possible to use precast pavement panels having polygonal shapes other than the rectangular or quadrangular shapes as planar shapes for the lower pavement panels 3.

(Drainage Structure of Multilayer Precast Paved Road)

Here, an example of a drainage structure of the multilayer precast paved road will be described below based on FIG. 2.

Figure 2:
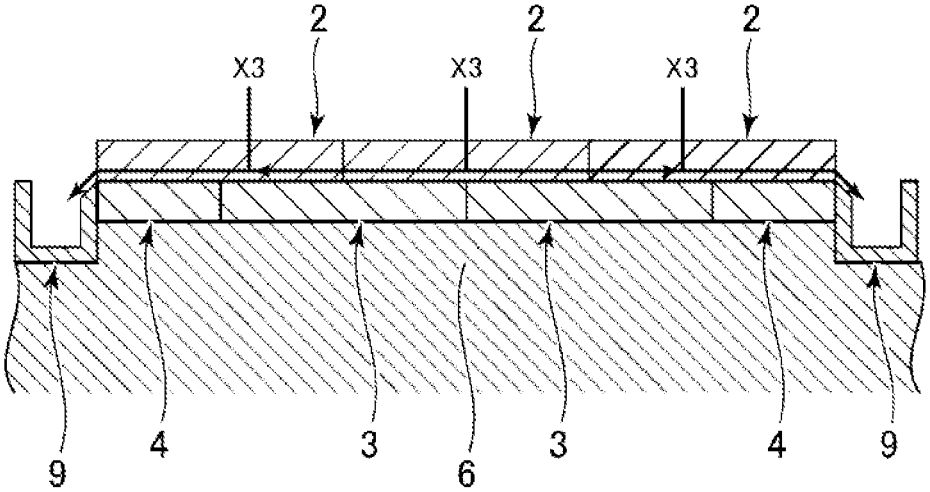
FIG. 2 is a partial sectional view illustrating a drainage structure of the multilayer precast paved road according to the first embodiment of the present invention.

FIG. 2 is a partial sectional view illustrating a drainage structure of the multilayer precast paved road according to the present invention, and in a case where the upper pavement panels 2 made of water-permeable concrete such as porous concrete are used for the upper layer as illustrated in the drawing, rain water flows inside the upper pavement panel 2 toward side grooves 8 at the roadside as illustrated by the arrow X3, and it is possible to efficiently drain the water to the side grooves 9 without allowing the water to penetrate the road panel 6 from the lower pavement panels 3 and the end portion lower pavement panels 4.

Second Embodiment

Next, a second embodiment of the multilayer precast paved road according to the present invention will be described below based on FIG. 3.

Figure 3:
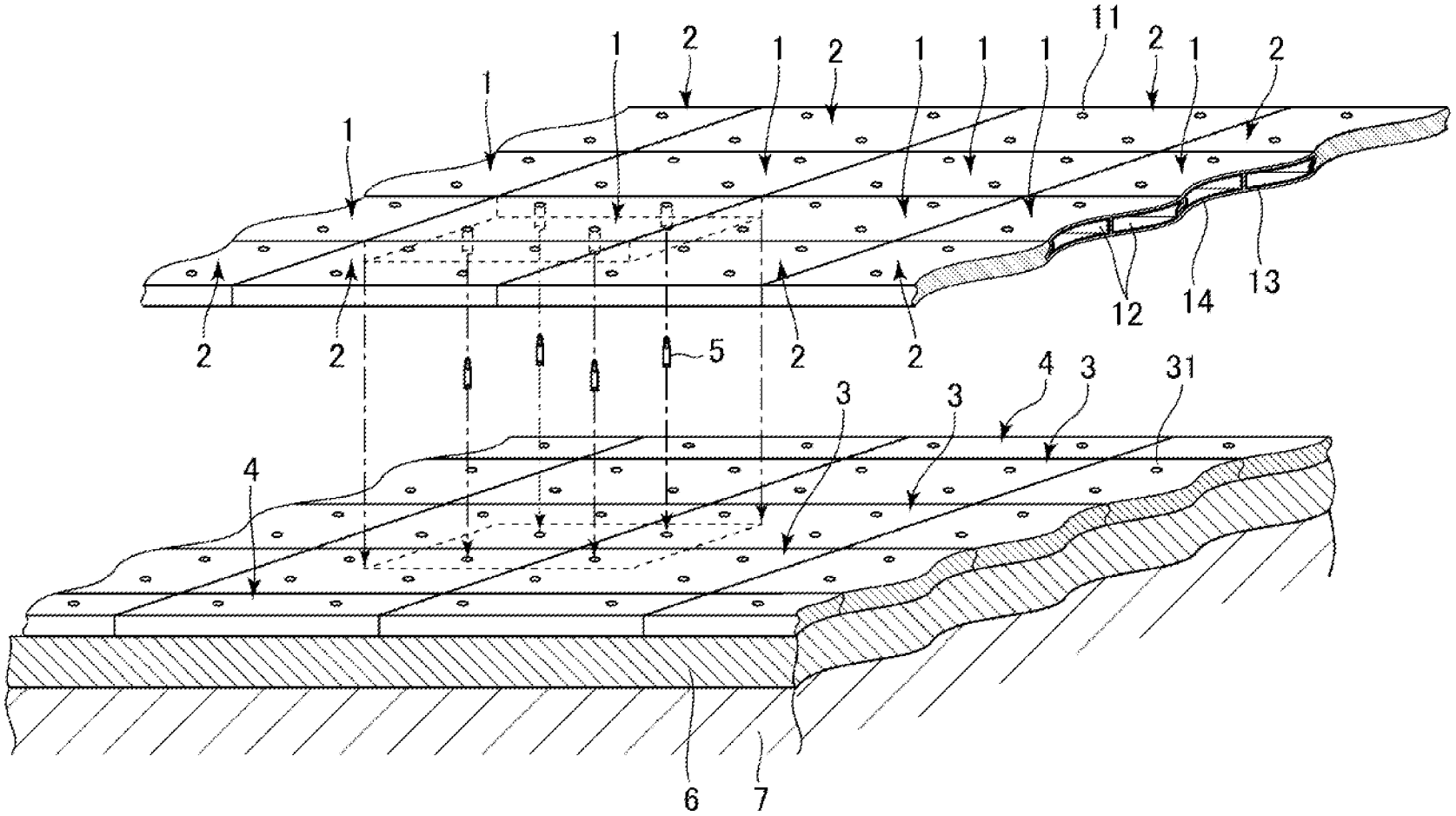
FIG. 3 is an exploded partial perspective view for explaining a configuration of a multilayer precast paved road according to a second embodiment of the present invention.

FIG. 3 is an exploded partial perspective view for explaining a configuration of the multilayer precast paved road according to the second embodiment of the present invention. Note that in FIG. 3, the same reference signs will be applied to the same elements as the elements illustrated in FIG. 1, and repeated description of the same elements will be omitted below.

The precast paved road according to the second embodiment of the present invention includes a plurality of lower pavement panels 3 and end portion lower pavement panels 4 with rectangular plate shapes configured to be laid on a road panel 6 provided on a roadbed 7 and a plurality of upper pavement panels 2 and hollow pavement panels 1 with rectangular plate shapes configured to be placed on tops of the lower pavement panels 3 and the end portion lower pavement panels 4 paved in this manner. Here, the hollow pavement panels 1 are provided instead of the upper pavement panels 2 located at substantially the center of the multilayer precast paved road illustrated in FIG. 1 in the width direction, and hollows 12 penetrating in the road extending direction are provided to penetrate through the inside of the hollow pavement panels 1. Note that since the other configuration of the multilayer precast paved road according to the present embodiment is the same as the configuration of the aforementioned multilayer precast paved road according to the first embodiment, repeated description of the same configuration will be omitted.

Incidentally, the positions at which the hollow pavement panels 1 are laid are not limited to substantially the center of the road in the width direction and may be disposed at the roadside or other locations, for example. In addition, although the hollow pavement panels 1, the upper pavement panels 2, the lower pavement panels 3, and the end portion lower pavement panels 4 with the rectangular shapes having the same planar shapes and the same sizes are used in the present embodiment, it is also possible to use pavement panels with different sizes for the upper layer and the lower layer. Moreover, hollow pavement panels 1 with narrower widths than the hollow pavement panels 1 illustrated as an example in FIG. 3 may be used as the hollow pavement panels 1. Furthermore, various arrangement forms are conceivable as arrangement of the upper pavement panels 2, the lower pavement panels 3, and the end portion lower pavement panels 4 in the upper and lower layers including the hollow pavement, panels 1 in the multilayer precast paved road according to the present embodiment, such as a form in which the hollow pavement panels 1 are without lying between the lower pavement panels 3 and the hollow pavement panels 1 fill spaces between the upper pavement panels 2.

Note that although the hollow pavement panels 1, the upper pavement panels 2, the lower pavement panels 3, and the end portion lower pavement panels 4 having rectangular or quadrangular shapes in a plan view as basic shapes are used in the multilayer precast paved road according to the present embodiment, it is possible to use precast pavement panels with polygonal shapes other than the rectangular or quadrangular shapes as planar shapes for the lower pavement panels 3.

(Configuration of Hollow Pavement Panels)

Here, a configuration of the hollow pavement panels 1 will be described below based on FIG. 4.

Figure 4:
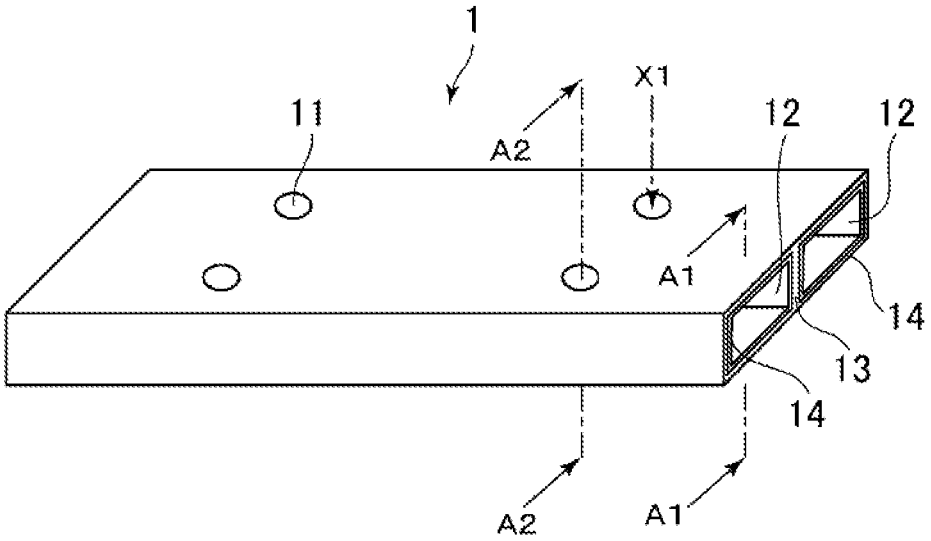
FIG. 4 is a perspective view of a hollow pavement panel constituting a part of an upper pavement panel of the multilayer precast paved road according to the second embodiment of the present invention.

FIG. 4 is a perspective view of the hollow pavement panels configuring a part of the upper pavement panels in the multilayer precast paved road according to the second embodiment of the present invention.

The hollow pavement panel 1 illustrated as an example in FIG. 4 has a section with substantially a rectangular shape in the transverse direction, has substantially an oblong shape in a plan view, and joint holes 11 with circular hole shapes penetrating in the thickness direction and hollows 12 penetrating in the road extending direction are formed in the hollow pavement panel 1. Here, two hollows 12 are provided in parallel in this example, and a partitioning wall 13 partitioning the hollows 12 in the road extending direction is provided between the two hollows 12. Note that the planar size of the hollow pavement panel 1 and the sectional shapes and the sizes of the hollows 12 are not limited to the examples illustrated in the present embodiment.

Figure 5:
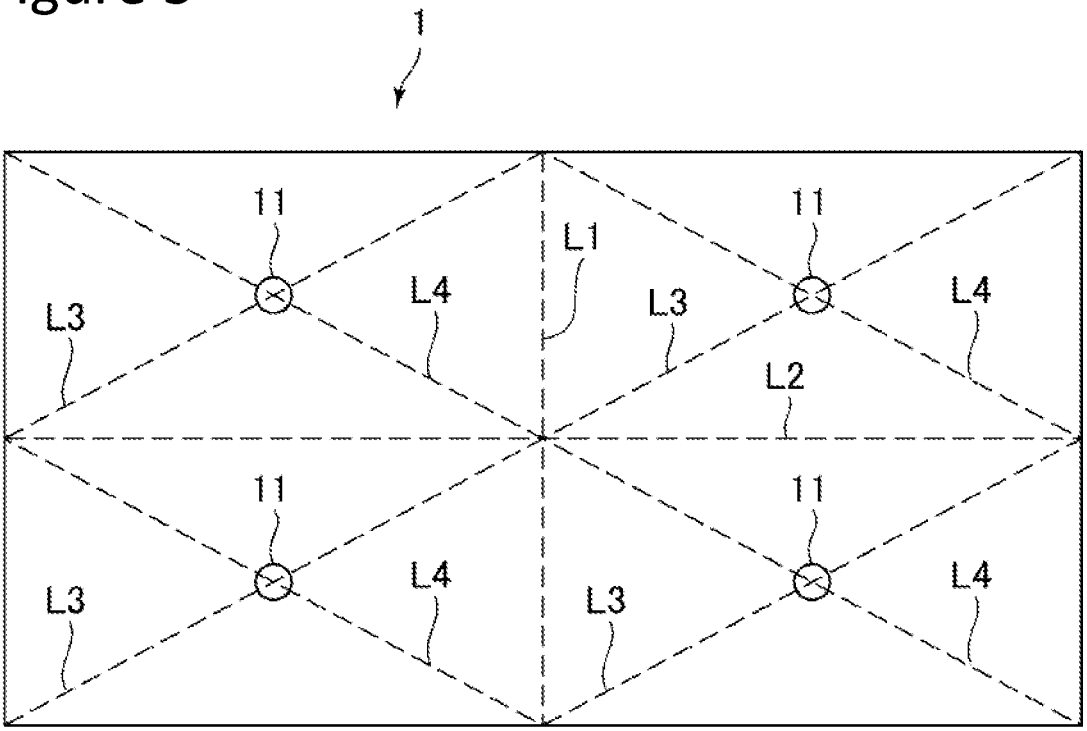
FIG. 5 is a plan view illustrating an arrangement example of a plurality of joint holes provided in the hollow pavement panel of the multilayer precast paved road according to the second embodiment of the present invention.

FIG. 5 is a plan view illustrating an arrangement example of the plurality of (four in the illustrated example) joint holes 11 provided in the hollow pavement panel 1. In the present embodiment, the joint holes 11 (110: see FIGS. 10 and 11) are formed in the same arrangement pattern in each of the other pavement panels (the upper pavement panels 2, the lower pavement, panels 3, and the end portion lower pavement panels 4). Note that the joint holes 110 (see FIGS. 10 and 11) formed in each of the lower pavement panels 3 and the end portion lower pavement panels 4 as will be described later preferably have a specification that the joint holes 110 do not penetrate through the lower pavement panels 3 and the end portion lower pavement panels 4 in the up-down direction. This is for preventing rain water and the like from the side of the upper pavement panels 2 including the hollow pavement panels 1 from flowing into the road panel 6 through the joint holes 110.

As illustrated in FIGS. 4 and 5, the four joint holes 11 are provided in an example, and in a case where the hollow pavement panel 1 has a rectangular shape in a plan view, each joint hole 11 is formed at each of intersections between first diagonal lines L3 and second diagonal lines L4 of four oblongs sectioned by a straight line L1 that equally divides the rectangular shape on the left and right sides and a straight line L2 that equally divides the rectangular shape on the upper and lower sides.

If the four joint holes 11 (110) are arranged in the same arrangement pattern in each of the pavement panels (the hollow pavement panels 1, the upper pavement panels 2, the lower pavement panels 3, and the end portion lower pavement panels 4) as described above, and in a case where the lower pavement panels 3 and the end portion lower pavement panels 4 arranged in the lower layer and the hollow pavement panels 1 and the upper pavement panels 2 arranged in the upper layer are arranged in a zigzag manner in the multilayer precast paved road according to the present invention, the joint holes 110 in the lower pavement panels 3 and the end portion lower pavement panels 4 arranged in the lower layer and the joint holes 11 in the hollow pavement panels 1 and the upper pavement panels 2 arranged in the upper layer are arranged at corresponding coaxial positions, and it is thus possible to couple (fasten) the hollow pavement panels 1 and the upper pavement panels 2 to the lower pavement panels 3 and the end portion lower pavement panels 4 using joint members 5 in the up-down direction.

Instead of the positions described above, the positions of the joint holes 11 (110) in the present embodiment may be arranged to be closer to the inner side or the outer side of the pavement panel in consideration of the load placed on the pavement panel. Also, the number of the joint holes 11 (110) is also not limited to four, and the number may be more than four or less than four depending on the sizes of the pavement panels (the hollow pavement panels 1, the upper pavement panels 2, the lower pavement panels 3, and the end portion lower pavement panels 4).

Figure 6:
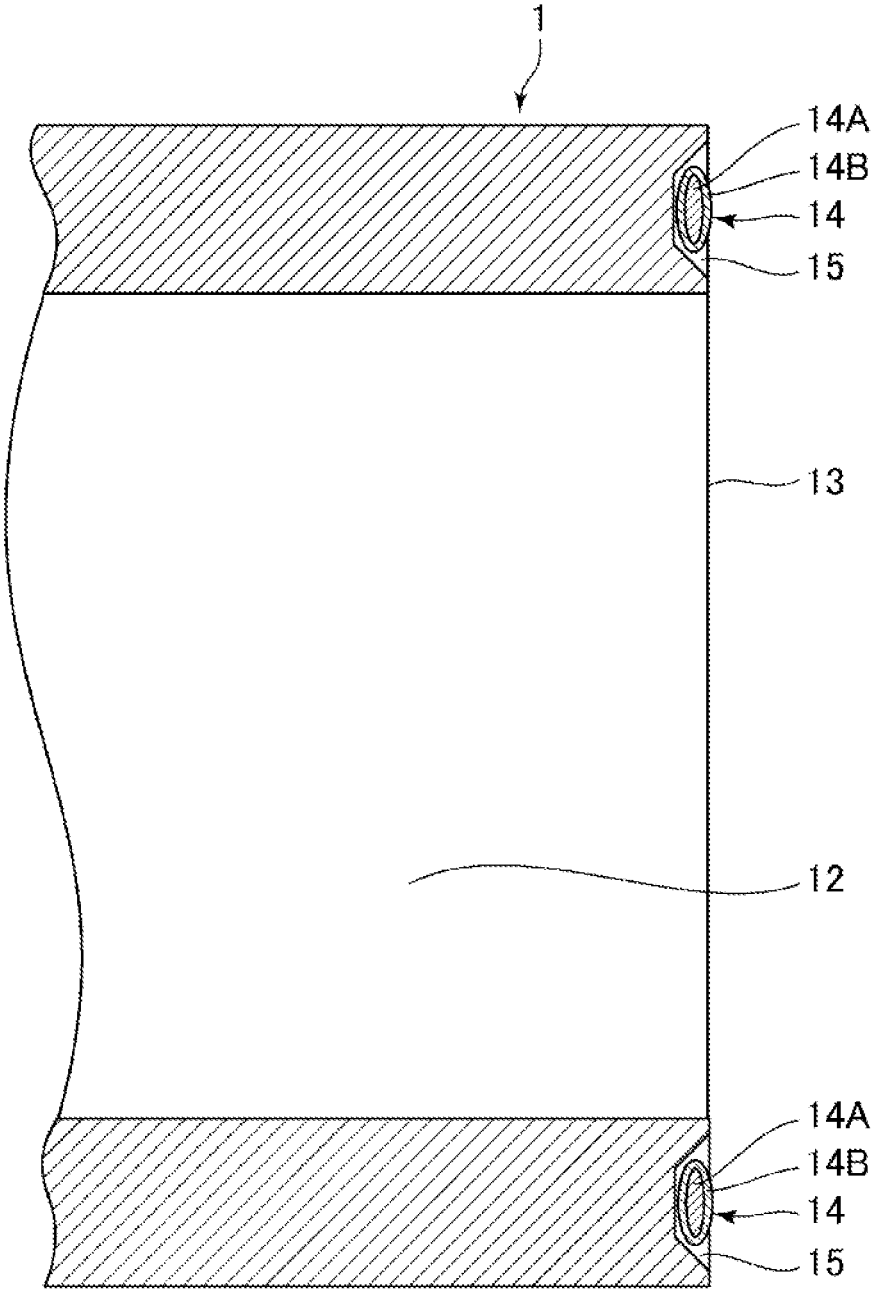
FIG. 6 is a sectional view along the line A1-A1 in FIG. 4.

FIG. 6 is a sectional view along the line A1-A1 in FIG. 4, and as illustrated in the drawing, the hollow pavement panel 1 illustrated in FIG. 4 includes water stop seals 14 provided at groove portions 15 provided to circle the end surfaces of the opening portions of the hollows 12. Here, each water stop seal 14 includes an expanding portion 14A and a hydrophilic portion 14B covering the expanding portion 14A. Note that although urethane foam compressed in the road extending direction, for example, is used for the expanding portion 14A in the present embodiment, a material other than the urethane foam can be used for the expanding portion 14A. Also, although a material that swells when the material is brought into contact with water, such as hydrophilic urethane, for example, is used for the hydrophilic portion 14B, the material is not limited to hydrophilic urethane as long as the material swells when the material is brought into contact with water, and another material may be used.

Therefore, in a case where the hollow pavement panels 1 are connected to each other in the road extending direction, the water stop seals 14 swell in the road extending direction even if rain water penetrates the connecting parts, and the rain water is prevented from penetrating the inside of the hollows 12.

(Another Form of Hollow Pavement Panel)

Here, another form of the hollow pavement panel will be described below based on FIG. 7.

Figure 7:
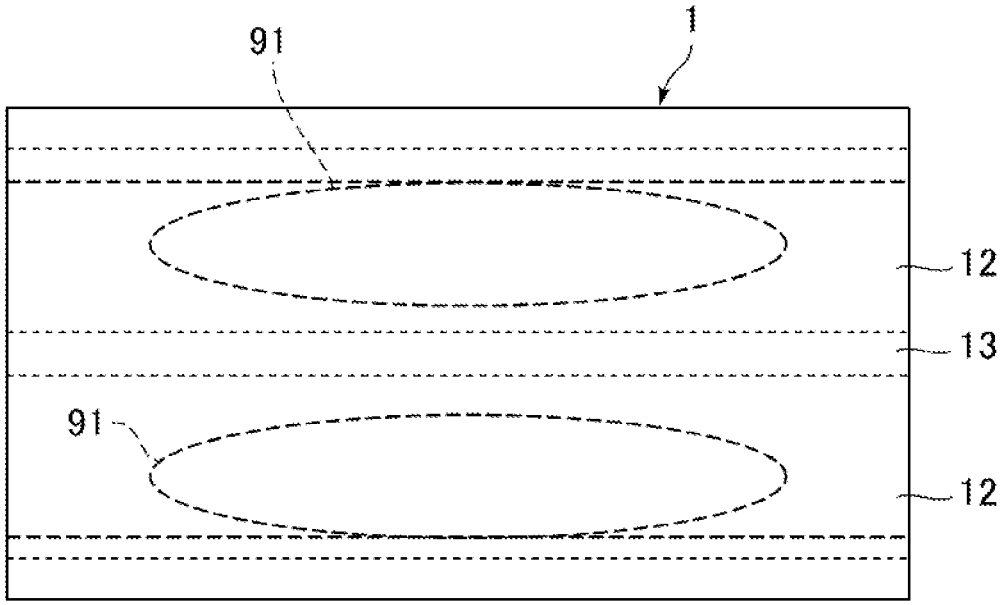
FIG. 7 is a plan view illustrating another form of the hollow pavement panel.

FIG. 7 is a plan view illustrating another form of the hollow pavement panel, and in the illustrated example, non-contact power supply coils 91 are arranged in the hollow pavement panel 1.

As illustrated in FIG. 7, the hollow pavement panel 1 can be modularized with the non-contact power supply coils 91 arranged inside the hollows 12. In this case, adjacent non-contact power supply coils 91 are connected to each other by an appropriate method. Here, since the hollow pavement panel 1 has the water stop seals 14, the non-contact power supply coils 91 do not wet due to rain water and the like.

Note that the hollow pavement panel 1 can also be modularized as a pavement panel with a cable, with cable such as power source lines and communication lines in addition to the non-contact power supply coils 91 disposed in the hollows 12.

(Coupling Structure between Upper Pavement Panel and Lower Pavement Panel)

First Embodiment of Coupling Structure

Figures 8A, 8B:
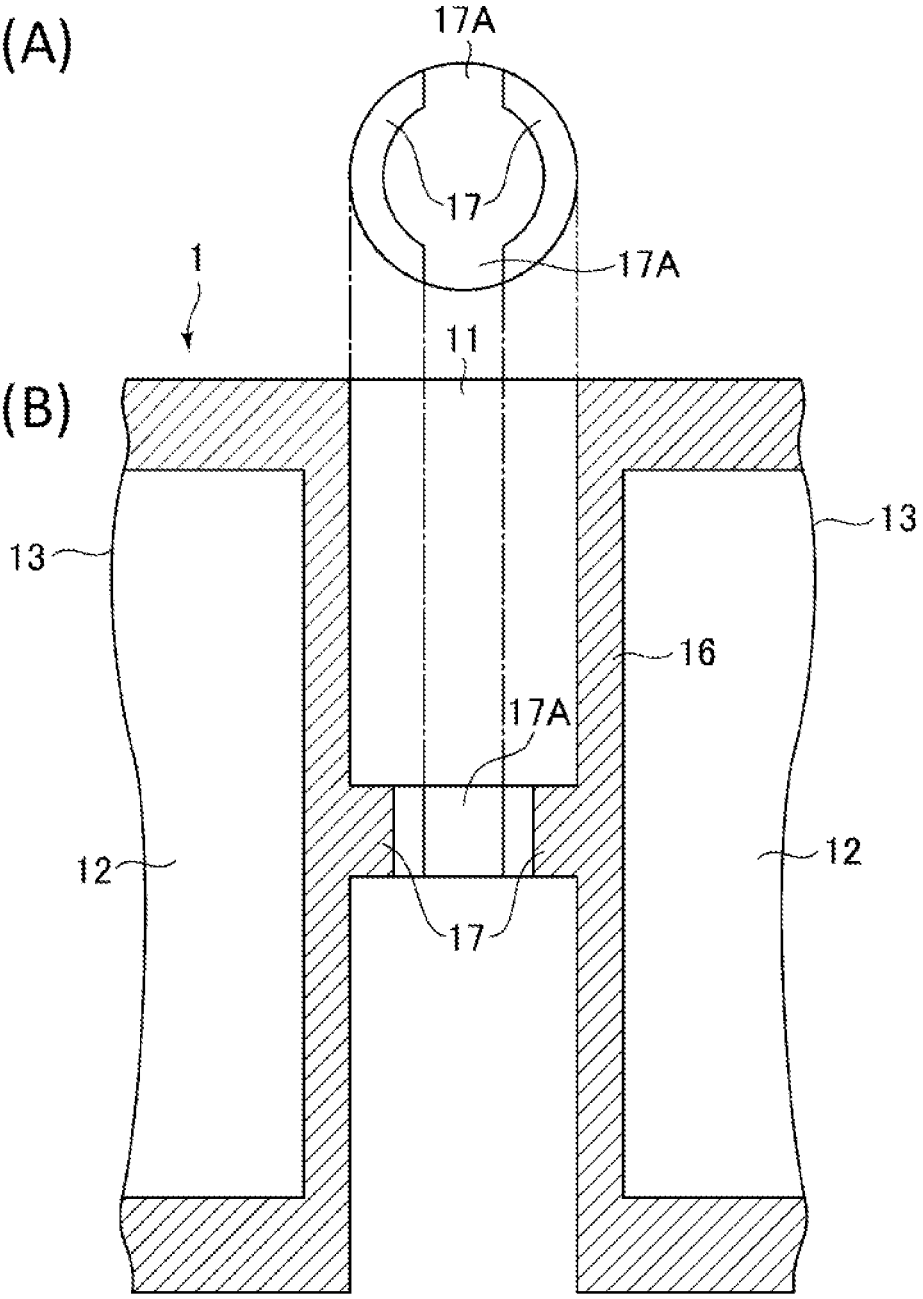
FIG. 8(A) is a diagram in the direction of the arrow X1 in FIG. 4.
FIG. 8(B) is a sectional view along the line A2-2 in FIG. 4.

FIG. 8(A) is a diagram in the direction of the arrow X1 in FIG. 4, FIG. 8(B) is a sectional view along the line A2-A2 in FIG. 4, and as illustrated in FIG. 8(B), the hollow pavement panel 1 includes a tubular peripheral wall 16 forming each joint holes 11 and arc-shaped protruding portions 17 provided near the middle of inner surface of the peripheral wall 16 in the up-down direction of the joint hole 11.

The peripheral wall 16 is disposed inside the hollow 12, has substantially a circular shape in a plan view, and extends in the up-down direction. Also, the protruding portions 17 circle the inside of the peripheral wall 16 along the peripheral wall 16 and have a pair of notches 17A at a part of the circling direction.

The hollow pavement panel 1 is formed using a synthetic resin that exhibits molding strength that is sufficient for a road. Examples of the synthetic resin include FRP and various high-strength plastics (such as PAI and PEEK), and it is also possible to use the hollow pavement panel 1 made of carbon fiber reinforced concrete or FRP ferroconcrete as well as the hollow pavement panel 1 made of a synthetic resin. It is possible to achieve high water tightness, non-conductivity, and non-magnetism and to dispose the non-contact power supply coils inside the hollows 12, by using the synthetic resin as the material of the hollow pavement panel 1.

The upper pavement panels 2 and the lower pavement panels 3 according to the present invention have forms similar to the outer shapes of the hollow pavement panels 1 other than that the sections of the hollow pavement panels 1 with no hollows 12 are configured in a filled form and the upper pavement panels 2 and the lower pavement panels 3 are made of precast concrete provided with the joint holes 110 similar to the joint holes 11. Therefore, each joint hole 110 also includes arc-shaped protruding portions 170 and a pair of notches 170A.

Although each end portion lower pavement panel 4 has a form obtained by substantially equally dividing the lower pavement panel 3 into two parts on the upper and lower sides in a plan view in an example, the planar shape of the end portion lower pavement panel 4 is not limited to the example. Mote that it is desirable that the lower pavement panels 3 and the end portion lower pavement panels 4 have seals made of a water-swelling resin such as hydrophilic polyurethane at side surfaces that come into contact with each other when the lower pavement panels 3 and the end portion lower pavement panels 4 are paved such that the seals face each other.

The upper pavement panels 2 can have a structure made of porous concrete that allows water to penetrate therethrough, a porous structure to reduce running noise, or a structure with slits provided in the surfaces. The lower pavement panels 3 and the end portion lower pavement panels 4 can be formed using ferroconcrete, steel fiber reinforced concrete, or fiber reinforced concrete. Note that it is possible to use ferroconcrete, steel fiber reinforced concrete, or fiber reinforced concrete for the upper pavement panels 2 as well. The multilayer precast paved road according to the present invention can have strength and durability of the paved road through utilization of the concrete material for the lower pavement panels 3 and the end portion lower pavement panels 4. Note that in a case where the present invention is applied to a bridge, it is possible to connect the upper pavement panels 2 including the hollow pavement panels 1 directly to tops of floor plates by considering the floor plates constructed on a girder as the lower pavement panels 3 and to omit the lower pavement panels 3 including the end portion lower pavement panels 4.

Figure 9:
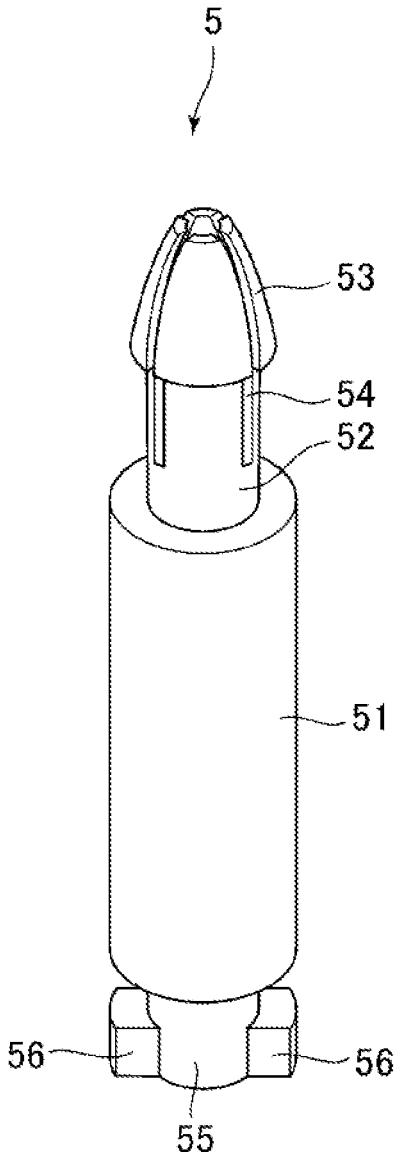
FIG. 9 is a perspective view illustrating an example of a joint member according to the second embodiment.

FIG. 9 is a perspective view illustrating an example of each joint member 5, and the illustrated joint member 5 includes a body portion 51 with substantially a columnar shape, a base portion 52 with a columnar shape disposed at an upper end of the body portion 51, a variable locking portion 53 with substantially an umbrella shape, a leg portion 55 extending downward, and a pair of flange portions 56 with substantially a projecting shape that are provided to integrally project on opposite sides in the circumferential direction of the leg portion 55.

The base portion 52 is set to have a smaller diameter than the diameter of the body portion 51, the variable locking portion 53 is set to have a lower end diameter that is larger than the diameter of the base portion 52 and smaller than the diameter of the body portion 51, and the diameter of the variable locking portion 53 gradually decreases toward the upper side. Also, four notch groove portions 54 with a slit shape cut from the upper end portion to midpoints of the base portion 52 are formed in the variable locking portion 53 at a pitch of an equal angle (90° pitch) in the circumferential direction. In other words, the notch groove portions 54 with a slit shape formed to be long in the up-down direction are formed to divide the variable locking portion 53 with substantially an umbrella shape and the base portion 52 into four parts in the circumferential direction.

Also, the leg portion 55 has a smaller diameter than the diameter of the body portion 51 and extends downward. In addition, the pair of flange portions 56 integrally formed on the opposite sides in the circumferential direction of the leg portion 55 have the same diameter (circumscribed circle diameter) as the diameter of the body portion 51 and have a planar shape with which the flange portions 56 can pass through the notches 170A (17A) of the protruding portions 170 (17) in the joint hole 110 (11). Note that the distance between the lower end surface of the body portion 51 and the upper end surfaces of the flange portions 56 (the apparent length of the leg portion 55) is set to be much longer than the thickness of the protruding portions 170 (17).

The joint members 5 are detachably attached to the four joint holes 110 formed in each of the lower pavement panels 3 and the end portion lower pavement panels 4, and the variable locking portions 53 with substantially an umbrella shape in the four joint holes formed in each of the hollow pavement panels 1 and the upper pavement panels 2 allow attachment and restrict detachment of each of the hollow pavement panels 1 and the upper pavement panels 2. Note that the variable locking portions 53 are not limited to the form with substantially an umbrella shape. This is because the variable locking portions 53 with substantially a columnar shape including the notch groove portions 54 instead of substantially an umbrella shape can be sufficiently used as long as the sectional shape of the inner peripheries of the protruding portions 17 is an inverse tapered shape, for example. Note that the joint members 5 can be made of plastic, metal, or a composite material of plastic and metal.

Figure 10:
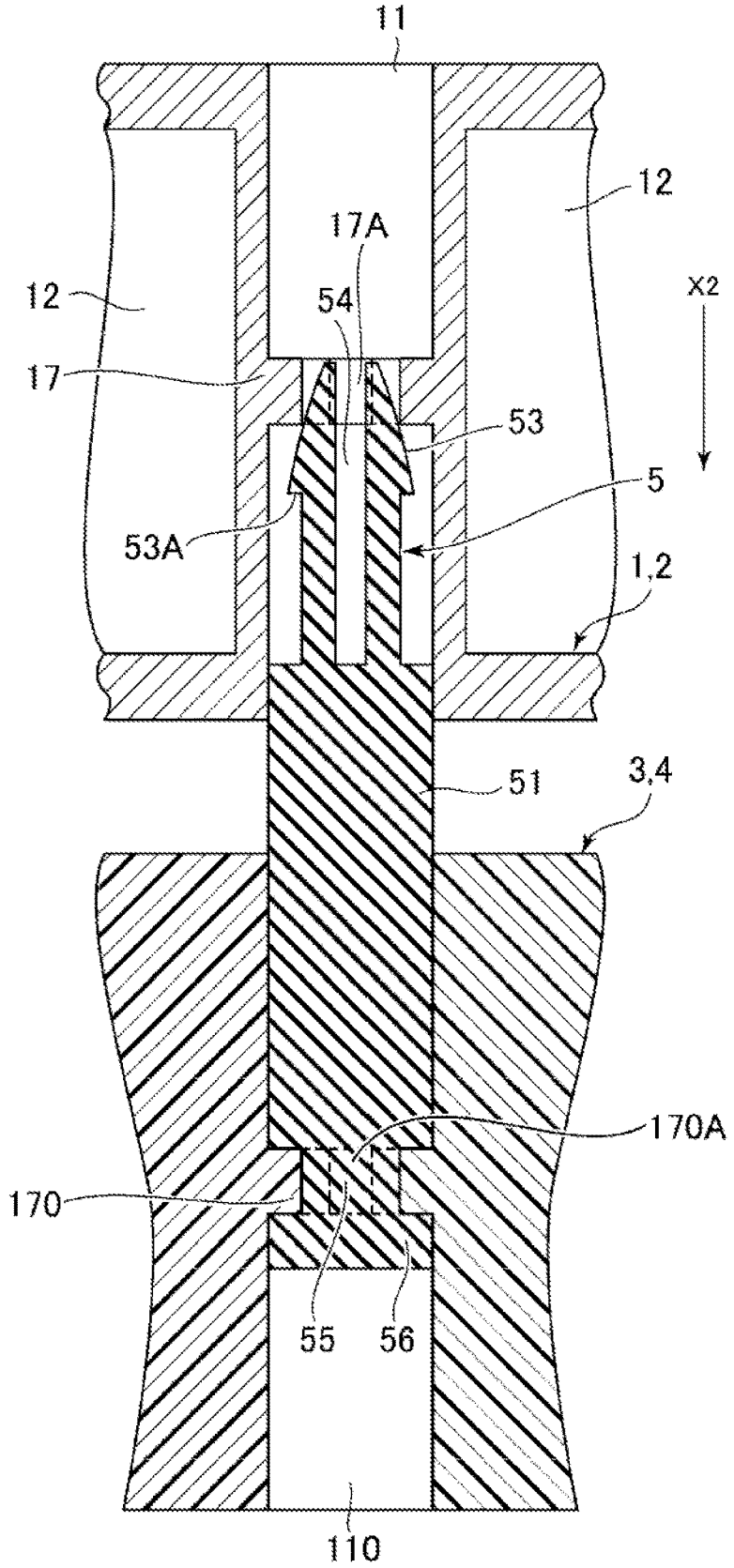
FIG. 10 is a sectional view illustrating a relationship of a hollow pavement panel and an upper pavement panel with respect to a joint member before coupling to a lower pavement panel and an end portion lower pavement panel on upper and lower sides, in a coupling structure according to the first embodiment.
Figure 11:
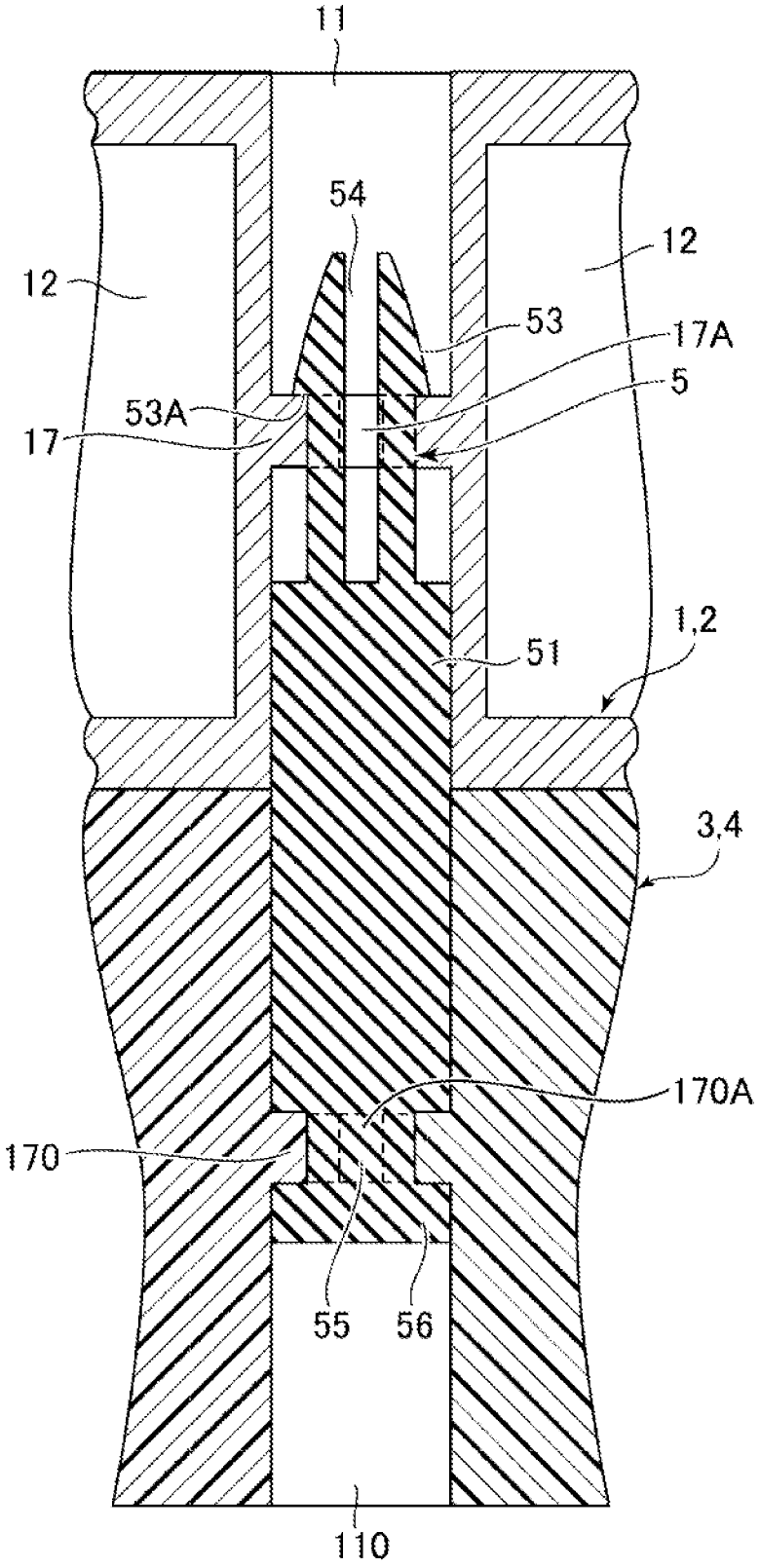
FIG. 11 is a sectional view illustrating a relationship of a state in which the hollow pavement panel and the upper pavement panel are coupled to a lower pavement panel and an end portion lower pavement panel with the joint member, in a coupling structure according to the second embodiment.

FIG. 10 is a sectional view illustrating a relationship of the hollow pavement panel 1 and the upper pavement panel 2 with respect to the joint member 5 before the coupling to the lower pavement panel 3 and the end portion lower pavement panel 4 on the upper and lower sides, and FIG. 11 is a sectional view illustrating a relationship of a state in which the hollow pavement panel 1 and the upper pavement panel 2 are coupled (fastened) to the lower pavement panel 3 and the end portion lower pavement panel 4 with the joint member 5.

As illustrated in FIG. 10, the pair of flange portions 56 at lower portions of the joint member 5 are inserted to deep parts of the protruding portions 170 through the notches 170A formed in the protruding portions 170 of the joint hole 110 in each of the lower pavement, panels 3 and the end portion lower pavement panels 4, and the flange portions 56 are then engaged with the protruding portions 170 of each of the lower pavement panel 3 and the end portion lower pavement panel 4 through rotation about an axis by an angle of 90°, for example, such that the joint member 5 is not pulled out both in the upward direction and in the downward direction.

In the aforementioned state, the hollow pavement panel 1 or the upper pavement panel 2 is placed from the upper side such that the joint member 5 is fitted into the joint hole 11 formed in the hollow pavement panel 1 or the upper pavement panel 2. Since the joint member 5 includes the variable locking portion 53 with substantially an umbrella shape including the notch groove portions 54, the variable locking portion 53 with substantially an umbrella shape enters between the protruding portions 17 if the notch groove portions 54 of the variable locking portion 53 is pressed and made to contract by the protruding portions 17, and a lower end portion 53A of the variable locking portion 53 opens when the variable locking portion 53 passes through the protruding portions 17.

Since the diameter of the lower end portion 53A of the variable locking portion 53 with substantially an umbrella shape is larger than the diameter of the circumscribed circle of the pair of protruding portions 17, the hollow pavement panel 1 or the upper pavement panel 2 fitted to the joint member 5 is not pulled in the upward direction. In this manner, the upper pavement panel 2 including the hollow pavement panel 1 are tightly coupled to the lower pavement panel 3 including the end portion lower pavement panel 4 via the joint member 5, and the upper pavement panel 2 (including the hollow pavement panel 1) and the lower pavement panel 3 (including the end portion lower pavement panel 4) forming the two upper and lower layers are coupled to and integrated with each other.

Note that the joint member 5 used in the multilayer precast paved road according to the present invention is not limited to the joint member 5 used in the present embodiment. For example, it is possible to use a joint member in a form in which the leg portion 55 formed at the lower portion of the joint member 5 and the flange portions 56 with substantially a projecting shape provided on the periphery of the leg portion 55 are provided at the upper portion of the body portion 51 with a vertically symmetric orientation instead of the variable locking portion 53 with substantially an umbrella shape provided at the joint member 5, although not illustrated in the drawing. In addition, the joint member can also employ a form in which a jig hole such as a through-hole is provided on a center axis and the jig hole is caused to hold a jig to rotate the joint member. As the variable locking portion, a variable locking portion that itself is deformed to achieve the locking function and a variable locking portion that itself is displaced to achieve the locking function are conceivable.

Figure 12:
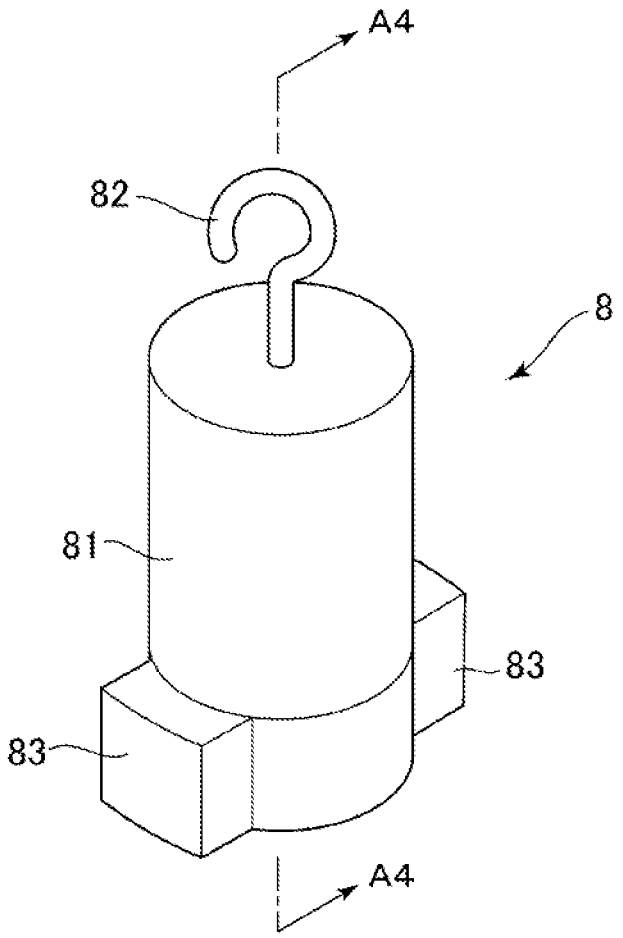
FIG. 12 is a perspective view illustrating an example of a removing tool for the joint member.
Figure 13:
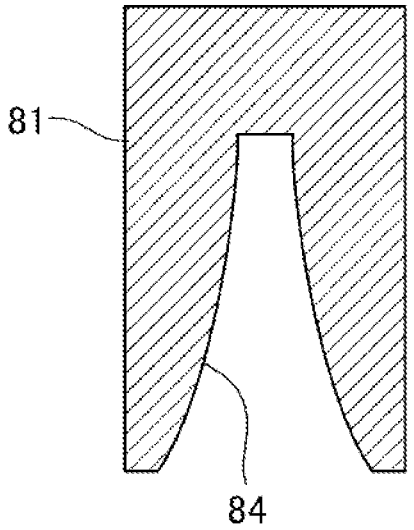
FIG. 13 is a sectional view along the line A4-A4 in FIG. 12.

FIG. 12 is a perspective view illustrating an example of a removing tool 9 for the joint member 5, and FIG. 13 is a sectional view along the line A4-A4 in FIG. 12.

The removing tool 8 includes a pressurizing portion 81 in which a hollow portion 84 with a diameter gradually increasing toward the lower side (see FIG. 13) is opened from the lower end surface, a pair of catching protruding portions 83 provided on opposite sides of the lower end portion of the pressurizing portion 81, and a hook 82 provided at the upper end portion of the pressurizing portion 81.

Here, the maximum diameter of the hollow portion 84 of the removing tool 8 is the same as or slightly smaller than the maximum diameter of the variable locking portion 53 with substantially an umbrella shape. Also, the length of the hollow portion 84 in the up-down direction is the same as or slightly longer than the length of the variable locking portion 53 with substantially an umbrella shape in the up-down direction, and the hollow portion 84 has a curved surface projecting inward in the vertical section as illustrated in FIG. 13.

Also, the length form one end to the other end of the catching protruding portions 83 is substantially equal to the diameter of the joint hole 11. In addition, the outer diameter of the pressurizing portion 81 is slightly smaller than the diameter of the circumscribed circle of the protruding portions 17.

In order to remove the hollow pavement panel 1 or the upper pavement panel 2 from the joint member 5, the removing tool 8 is pressurized from the upper side such that the variable locking portion 53 with substantially an umbrella shape is fitted to the hollow portion 84.

Since the variable locking portion 53 with substantially an umbrella shape has the notch groove portions 54, the variable locking portion 53 is pressurized by the hollow portion 84, the notch groove portions 54 contract in the radial direction, and the engagement between the lower end portion 53A of the variable locking portion 53 with substantially an umbrella shape and the protruding portions 17 is then cancelled.

If the catching protruding portions 83 are further pressed downward with an orientation in which the catching protruding portions 83 do not interfere with the protruding portions 17 in the above state, and the removing tool 8 is caused to rotate when the catching protruding portions 83 exceed the protruding portions 17, then the catching protruding portions 83 are engaged with the protruding portions 17. If the removing tool 8 is pulled upward using a wire or the like hooked on the hook 82 in this state, then the hollow pavement panel 1 or the upper pavement panel 2 can be removed from the joint member 5. This operation is performed on the joint holes 11 at four locations in the hollow pavement panel 1 or the upper pavement panel 2, thereby separating the hollow pavement panel 1 or the upper pavement panel 2 from the lower pavement panel 3 including the end portion lower pavement panel 4.

Second Embodiment of Coupling Structure

Next, the second embodiment of the coupling structure between the upper pavement panel 2 and the lower pavement panel 3 will be described below based on FIGS. 14 to 18.

Figure 14:
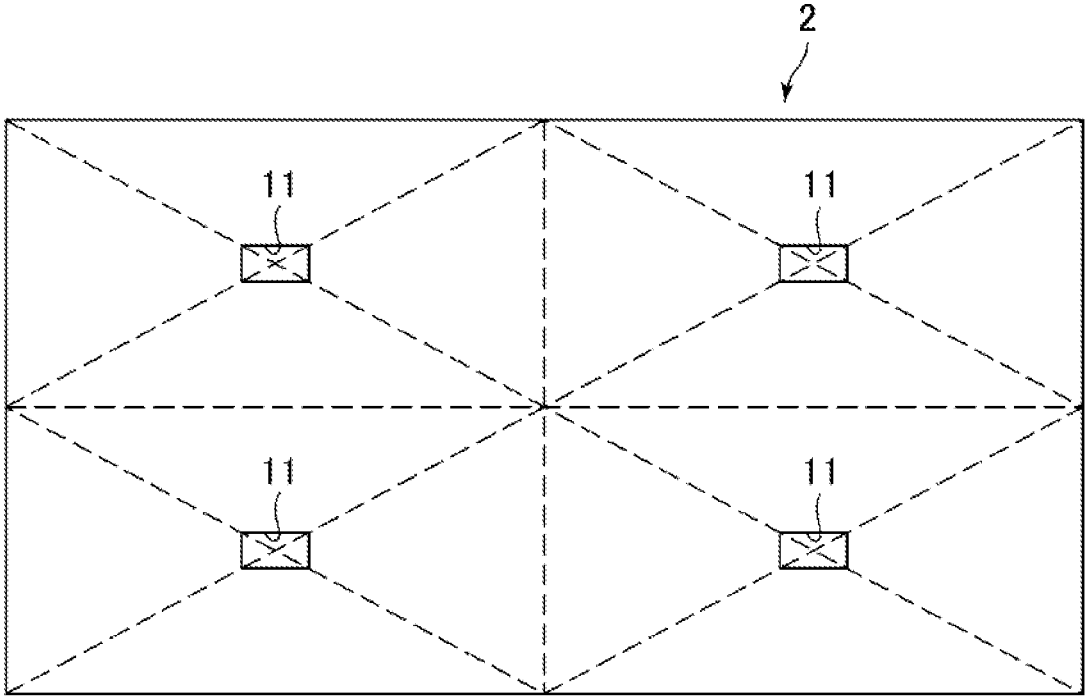
FIG. 14 is a plan view illustrating an arrangement example of a plurality of joint holes provided in the upper pavement panel and the lower pavement panel in the coupling structure according to the second embodiment.
Figure 15:
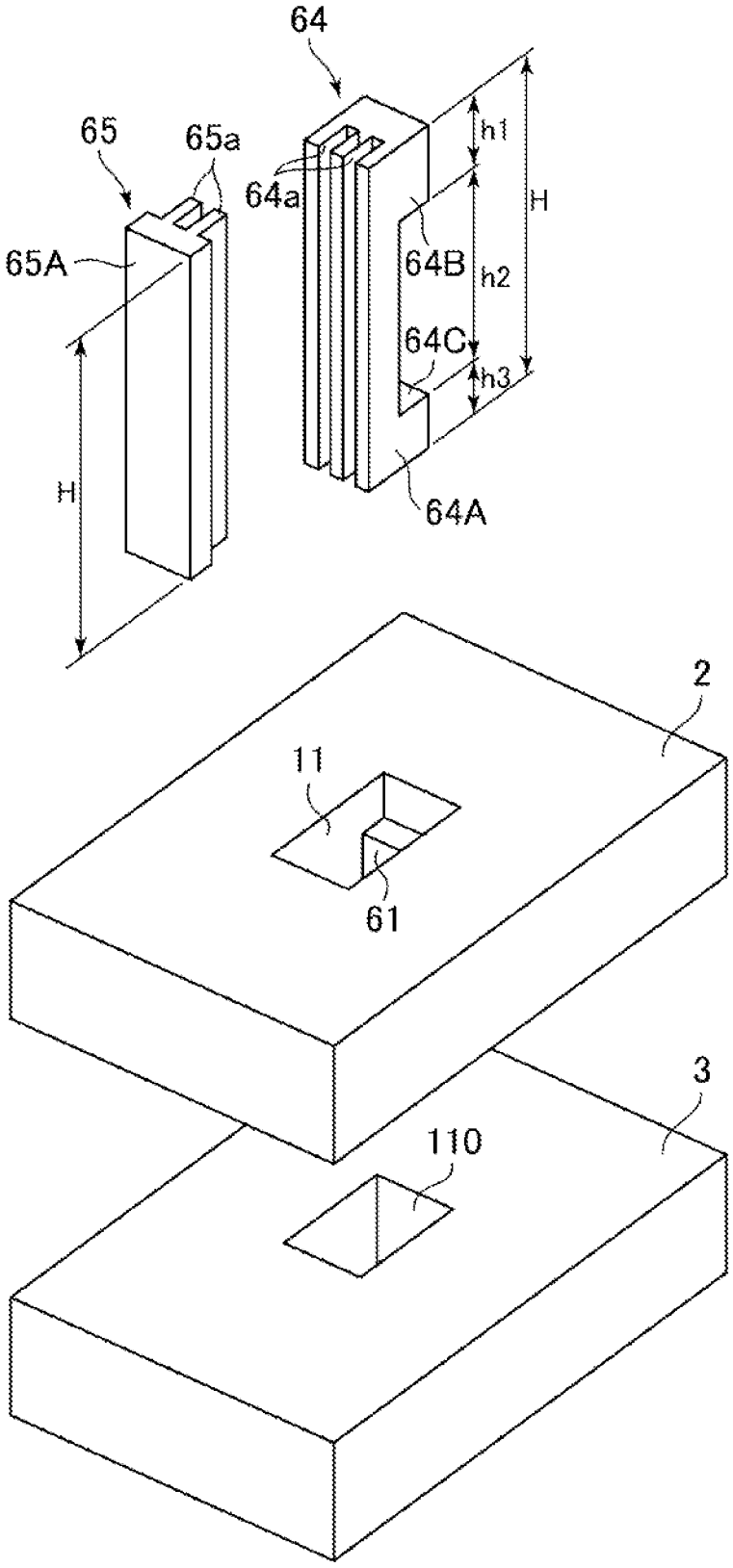
FIG. 15 is an exploded perspective view illustrating the coupling structure according to the second embodiment.
Figure 16A:
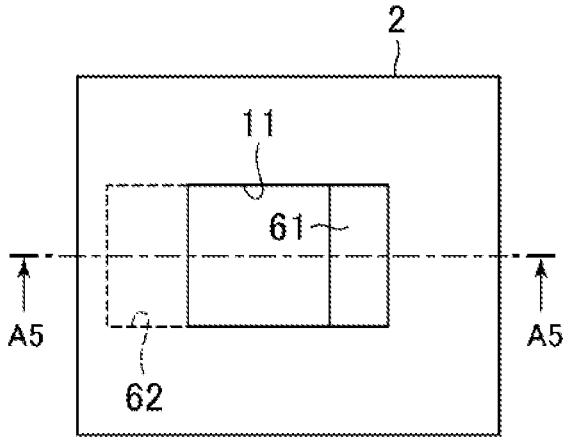
FIG. 16(A) is a partial plan view of the upper pavement panel.
Figure 16B:
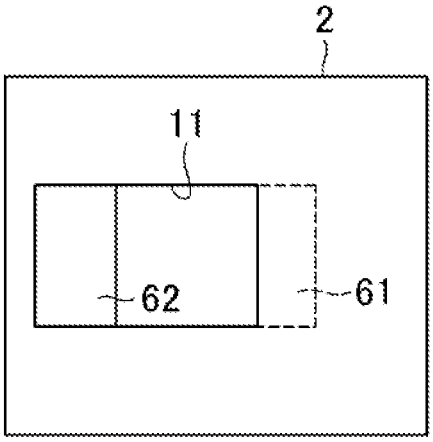
FIG. 16(B) is a partial bottom view of the upper pavement panel.
Figure 16C:
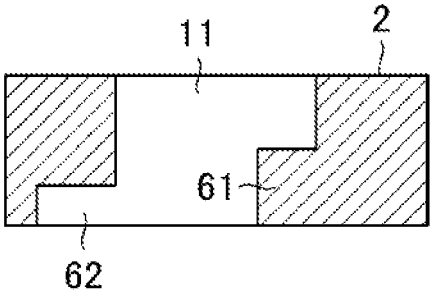
FIG. 16(C) is a sectional view along the line A5-A5 in FIG. 16(A).

FIG. 14 is a plan view illustrating an arrangement example of the plurality of joint holes provided in the upper pavement panel and the lower pavement panel in the coupling structure according to the second embodiment, FIG. 15 is an exploded partial perspective view illustrating the coupling structure according to the second embodiment, FIG. 14(A) is a partial plan view of the upper pavement panel. FIG. 14(B) is a partial bottom view of the upper pavement panel. FIG. 14(C) is a sectional view along the line A5-A5 in FIG. 14(A), FIG. 15(A) is a partial plan view of the lower pavement panel. FIG. 15(B) is a sectional view along the line A6-A6 in FIG. 15(A), FIGS. 16(A) to 16(F) are partial sectional views illustrating, in a process order, a procedure for coupling the upper pavement panel to the lower pavement panel in the coupling structure according to the second embodiment.

Figure 17A:
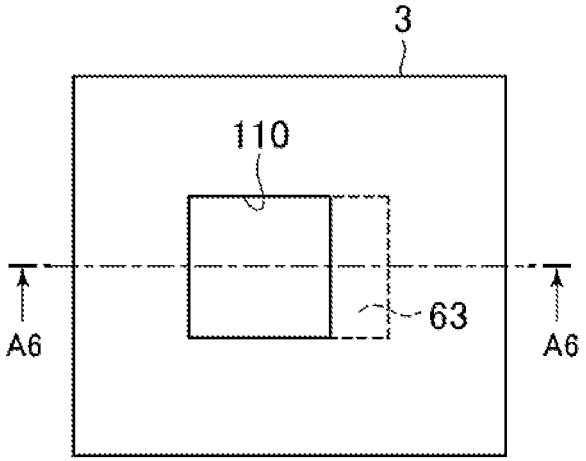
FIG. 17(A) is a partial plan view of the lower pavement panel.
Figure 17B:
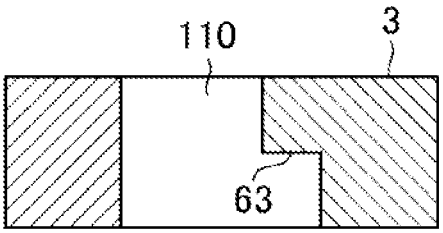
FIG. 17(B) is a sectional view along the line A6-A6 in FIG. 17(A).

In the coupling structure according to the present embodiment, the joint holes 11 and 110 (only the joint holes 11 are illustrated in FIG. 14) with an oblong shape in a plan view are provided to penetrate through each of the upper pavement panel 2 and the lower pavement panel 3 in the up-down direction at four locations (the same locations as the locations in the first embodiment (see FIG. 5)) as illustrated in FIG. 14 (see FIGS. 15 and 17 for the joint holes 110 formed in the lower pavement panel 3). Note that although peripheral structures of the joint hole 11 at one location and the joint hole 110 at one location will be illustrated and described below, peripheral structures of the joint holes 11 and 110 at the other locations are the same, and illustration and description of the peripheral structures of the joint holes 11 and 110 at the other location will be omitted.

As illustrated in FIG. 16, an engagement projecting portion 61 with a rectangular block shape is integrally formed at a lower half portion of a surface on a side of a short side (the right end surface in FIG. 16) in the joint hole 11 with an oblong shape in a plan view formed in the upper pavement panel 2. Also, an engagement recessed portion 62 with a rectangular shape in a plan view extending in the longitudinal direction (to the left side in FIG. 16) of the joint hole 11 from the surface on a side of a short side of the joint hole 11 facing the engagement projecting portion 61 is formed in the lower surface of the upper pavement panel 2.

On the other hand, an engagement projecting portion 63 with a rectangular block shape is integrally formed at an upper half portion of the surface on the side of the short side (the right end surface in FIG. 17) of the joint hole 110 with an oblong shape in a plan view formed in the lower pavement panel 3 as illustrated in FIG. 17.

Incidentally, the joint member 64 made of a resin and a wedge member 65 illustrated in FIG. 15 are used to couple the upper pavement panel 2 to the lower pavement panel 3. Here, the joint member 64 includes a body portion 64A with a quadrangular columnar shape and engagement protrusions 64B and 64C with a rectangular block shape projecting integrally and horizontally in the same direction from the upper and lower ends of the same surface of the body portion 64A, and two fitting grooves 64*a* with a slit shape are provided at an appropriate interval in the width direction to penetrate through the surface of the body portion 64A on the side opposite to the side on which the engagement protrusions 64B and 64C are formed.

Also, the wedge member 65 includes a body portion 65A with a rectangular flat plate shape that is long in the up-down direction, and two fitting protrusions 65*a* with a rectangular rib shape that are long in the up-down direction are integrally provided to protrude from one end surface of the body portion 64A on a side of a long side. Here, the two fitting protrusions 65*a* are configured to foe fitted to the two fitting grooves 64*a* formed in the joint member 64 as will be described later and are disposed at the same pitch as the pitch of the fitting grooves 64*a* in the width direction.

Next, a procedure for coupling the upper pavement panel 2 to the lower pavement panel 3 using the aforementioned joint member 64 and the wedge member 65 will be described in accordance with FIGS. 19(A) to 18(F).

Figure 18A:
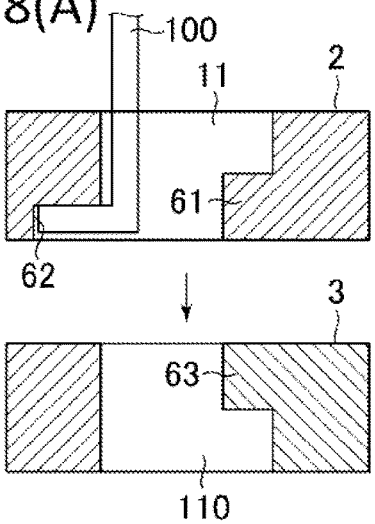
FIGS. 18(A) to 18(F) are partial sectional views illustrating, in a process order, a procedure for coupling the upper pavement panel to the lower pavement panel in the coupling structure according to the second embodiment.
Figure 18B:
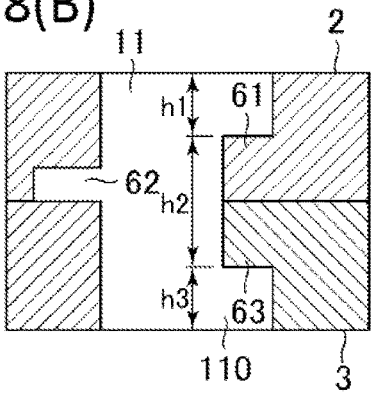
Figure 18C:
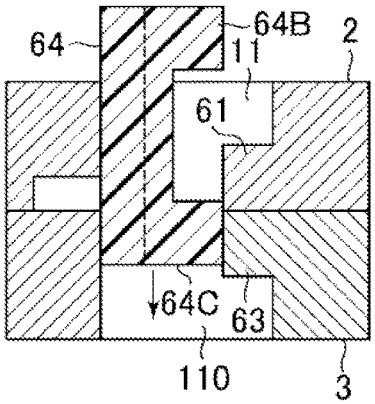

First, as illustrated in FIG. 13(A), a suspending tool 100 with a distal end portion bent in an L shape is inserted into the joint hole 11 in the upper pavement panel 2 from the upper side, and the distal end portion is caused to be engaged with the engagement recessed portion 62 in the upper pavement panel 2. Then, the suspending tool 100 is pulled up in the state to horizontally suspend the upper pavement panel 2. Then, the upper pavement panel 2 is caused to move to a position above the lower pavement panel 3 laid in advance, the upper pavement panel 2 is lowered in a state in which positioning has been carried out such that the joint holes 11 formed in the upper pavement panel 2 conform to the joint holes 110 formed in the lower pavement panel 3, and the upper pavement panel 2 is placed on the top of the lower pavement panel 3 as illustrated in FIG. 18(B). Note that the height dimensions h1, h2, and h3 of the components illustrated in FIG. 18(B) substantially conform to the dimensions h1, h2, and h3 of the components of the joint member 64 illustrated in FIG. 15, and the total value H of the heights of the upper pavement panel 2 and the lower pavement panel 3 substantially conforms to the height H of the joint member 64 and the wedge member 65.

The joint members 64 are inserted into and caused to pass through the joint holes 11 and 110 formed in the upper pavement panel 2 and the lower pavement panel 3, respectively, from the upper side as illustrated in FIG. 13(C) from the state in which the upper pavement panel 2 is placed on the top of the lower pavement panel 3 and the joint holes 11 and 110 formed in both the lower pavement panels 3 and the upper pavement panels 2 conform to each other as illustrated in FIG. 18(B). At this time, the joint members 64 can pass through the joint holes 11 and 110 without causing interference of the engagement protrusions 64B and 64C provided to protrude from the upper and lower portions of the joint members 64 with the engagement projecting portions 61 and 62 provided to project from the upper pavement panel 2 and the lower pavement panel 3, respectively.

Figure 18D:
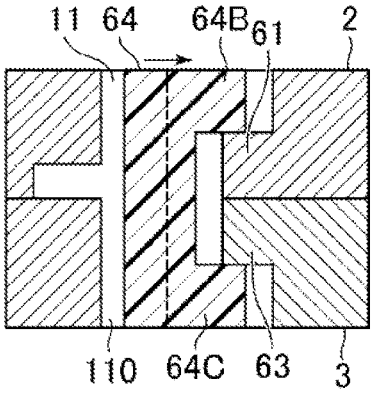

If the joint members 64 are caused to pass through the joint holes 11 and 110 formed in the upper pavement panel 2 and the lower pavement panel 3, respectively, as described above, then the joint members 64 are caused to move horizontally in the arrow direction as illustrated in FIG. 18(D), and the engagement protrusions 64B and 64C provided to project from the upper and lower portions of the joint members 64 are caused to be engaged with the engagement projecting portions 61 and 62 provided to project from the upper pavement, panel 2 and the lower pavement panel 3, respectively.

Figure 18E:
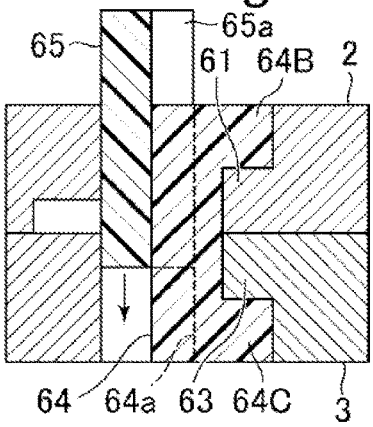

If the engagement protrusions 64B and 64C at the upper and lower portions of the joint members 64 are completely engaged with the engagement projecting portions 61 and 62 of the upper pavement panel 2 and the lower pavement panel 3, respectively, clearances are formed between the joint members 64 and the joint holes 11 and 110 as illustrated in FIG. 18(E), and the wedge members 65 are thus inserted into the clearances from the upper side. At this time, the two engagement protrusions 65*a* provided to protrude from each wedge member 65 are caused to be fitted to the two fitting grooves 64*a* formed in each joint member 64, and the wedge member 65 is driven downward with the state maintained.

Figure 18F:
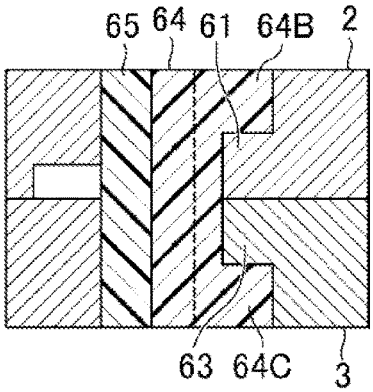

If the wedge members 65 are completely driven into the clearances between the joint members 64 and the joint holes 11 and 110 as described above, movement of the joint members 64 inside the joint holes 11 and 110 is inhibited and fixed as illustrated in FIG. 18(F), the engagement protrusions 64B and 64C at the upper and lower portions of the joint members 64 are reliably engaged with the engagement projecting portions 61 and 62 of the upper pavement panel 2 and the lower pavement panel 3, and the upper pavement panel 2 and the lower pavement panel 3 are reliably coupled to each other with the joint members 64.

Third Embodiment of Coupling Structure

Next, a third embodiment of a coupling structure between the upper pavement panel 2 including the hollow pavement panel 1 and the lower pavement panel 3 including the end portion lower pavement panel 4 will be described below based on FIGS. 19 to 21.

Figure 19A:
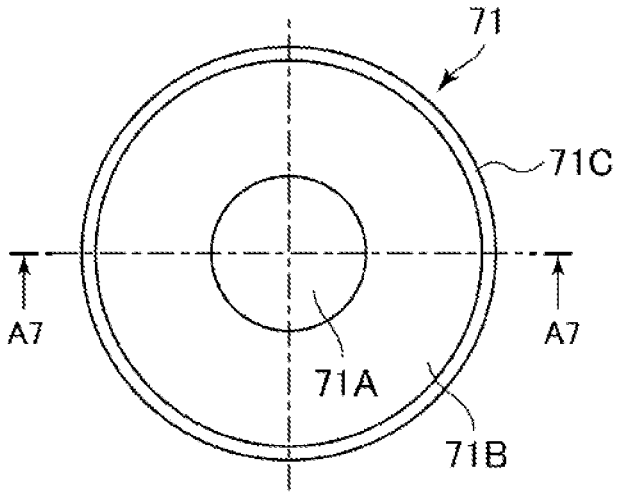
FIG. 19(A) is a plan view of a receiving member used in a coupling structure between an upper pavement panel and a lower pavement panel according to a third embodiment.
Figure 19B:
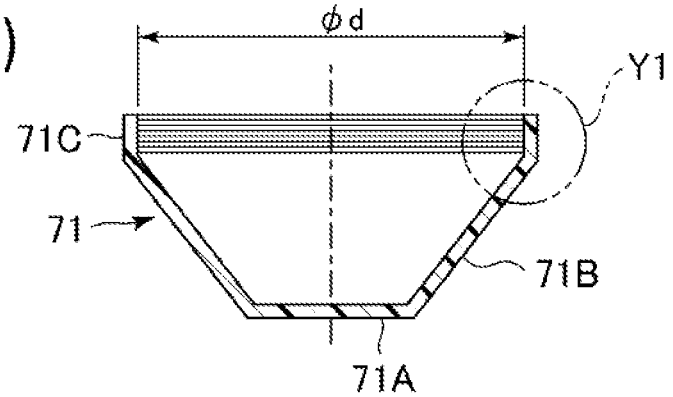
FIG. 19(B) is a sectional view along the line A7-A7 in FIG. 19(A)
Figure 19C:
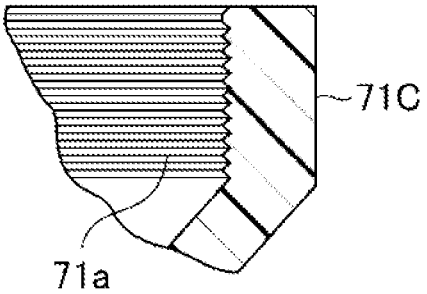
FIG. 19(C) is an enlarged detailed view of the Y1 portion in FIG. 19(B).
Figure 20A:
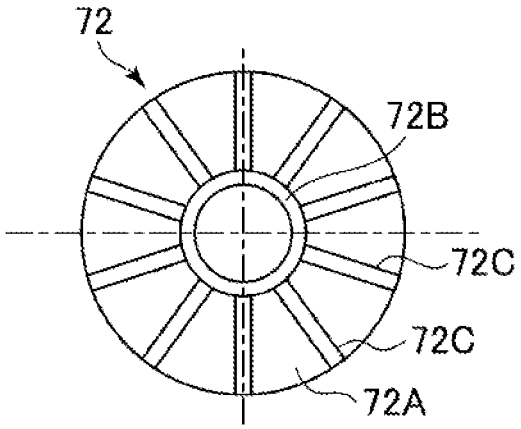
FIG. 20(A) is a plan view of a joint member used in the coupling structure between the upper pavement panel and the lower pavement panel according to the third embodiment.
Figure 20B:
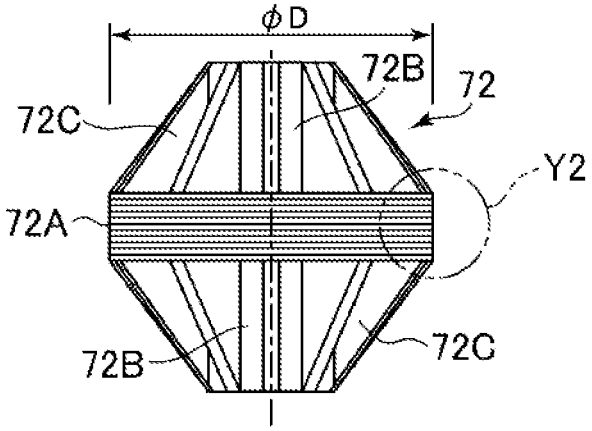
FIG. 20(B) is a front view of the joint member.
Figure 20C:
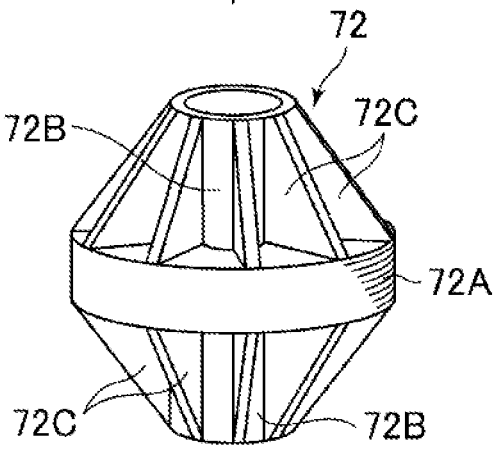
FIG. 20(C) is a perspective view of the joint member.
Figure 20D:
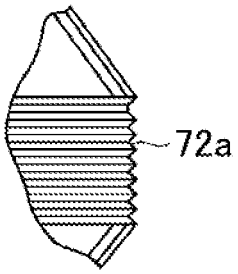
FIG. 20(D) is an enlarged detailed view of the Y2 portion in FIG. 20(B).

FIG. 19(A) is a plan view of a receiving member used in the coupling structure between the upper pavement panel and the lower pavement panel according to the third embodiment, FIG. 19(B) is a sectional view along the line A7-A7 in FIG. 19(A), FIG. 19(C) is an enlarged detailed view of the Y1 portion in FIG. 19(B), FIG. 20(A) is a plan view of a joint member used in the coupling structure between the upper pavement panel and the lower pavement panel according to the third embodiment. FIG. 20(B) is a front view of the joint member, FIG. 20(C) is a perspective view of the joint member. FIG. 20(D) is an enlarged detailed view of the Y2 portion in FIG. 20(B), and FIGS. 21(A) to 21(F) are partial sectional views illustrating, in a process order, a procedure for coupling the upper pavement panel to the lower pavement panel in the coupling structure according to the third embodiment.

Although the upper pavement panel 2 and the lower pavement panel 3 are coupled to each other at four locations in the coupling structure according to the present embodiment as well similarly to the illustration in FIGS. 5 and 14, a coupling structure at only one location will be described below.

In the coupling structure according to the present embodiment, a receiving member 71 illustrated in FIG. 19 and a joint member 72 illustrated in FIG. 20 are used. Here, both the receiving member 71 and the joint member 72 are integrally molded using a resin.

The receiving member 71 is molded into a cup shape as illustrated in FIG. 19 and includes a bottom surface portion 71A with a circular shape, a side surface portion 71B with a tapered cylindrical shape extending with a diameter increasing from the bottom surface portion 71A toward the upper side in FIG. 19(B), and a cylindrical portion 71C with a low height standing from the side surface portion 71B in parallel and forming an opening portion peripheral edge of the receiving member 71. Here, a plurality of protrusions 71*a* with a mountain-shaped section are formed over the entire inner periphery of the cylindrical portion 71C of the receiving member 71 as illustrated in FIG. 19(D) in detail.

As illustrated in FIG. 20, the joint, member 72 includes a disk portion 72A and cylindrical portions 72B extending vertically from the centers of the upper and lower surfaces of the disk portion 72A, and the disk portion 72A and the upper and lower cylindrical portions 72B are coupled to each other with a plurality of (ten in the illustrated example) reinforcing ribs 72C with a triangular shape. Here, the plurality of (ten) reinforcing ribs 72C are radially disposed at a pitch of an equal angle (36° pitch) in the circumferential direction. Also, the outer diameter ϕD of the disk portion 72A of the joint member 72 is set to be slightly smaller than the inner diameter ϕd of the cylindrical portion 71C of the receiving member 71 (ϕD≤ϕd). Moreover, a plurality of protrusions 72*a* with a mountain-shaped section are formed over the entire outer periphery of the disk portion 72A as illustrated in FIG. 20(D) in detail.

Next, a procedure for coupling the upper pavement panel 2 to the lower pavement panel 3 using the receiving member 71 and the joint member 72 configured as described above will be described below in accordance with FIGS. 21(A) to 21(D).

Figure 21A:
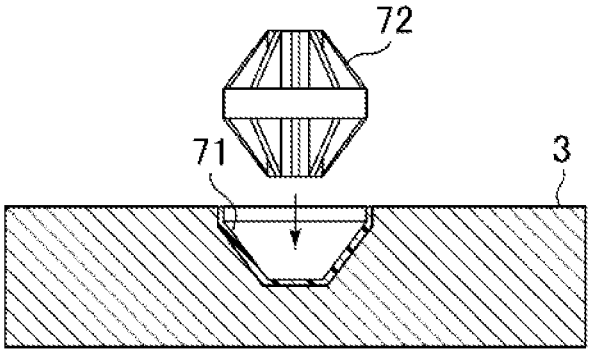
FIGS. 21(A) to 21(D) are partial sectional views illustrating, in a process order, a procedure for coupling the upper pavement panel to the lower pavement panel in the coupling structure according to the third embodiment.
Figure 21B:
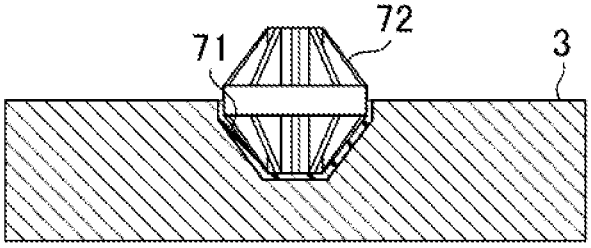

As illustrated in FIG. 21(A), the receiving member 71 is embedded in and fixed to the upper surface of the lower pavement panel 3 in advance, and the lower half portion of the joint member 72 is fitted to the receiving member 71 from the upper side to couple both the receiving member 71 and the joint member 72 as illustrated in FIG. 21(B). At this time, since the plurality of protrusions 71*a* are formed over the entire inner peripheral surface of the cylindrical portion 71C of the receiving member 71, and the plurality of protrusions 72*a* are similarly formed over the entire outer periphery of the disk portion 72A of the joint member 72 as well, the dropping of the joint member 72 from the receiving member 71 is prevented by the fitting between the protrusions 71*a* and 72*a*. In this state, the joint member 72 is coupled and fixed to the receiving member 71 in a state in which the upper half portion of the joint member 72 projects upward from the upper surface of the lower pavement panel 3.

Figure 21C:
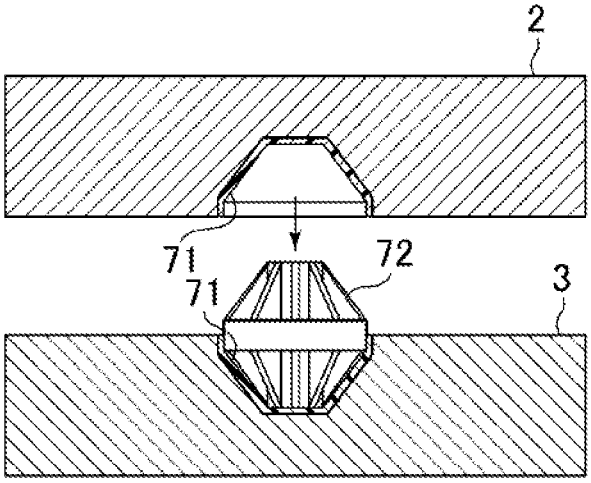
Figure 21D:
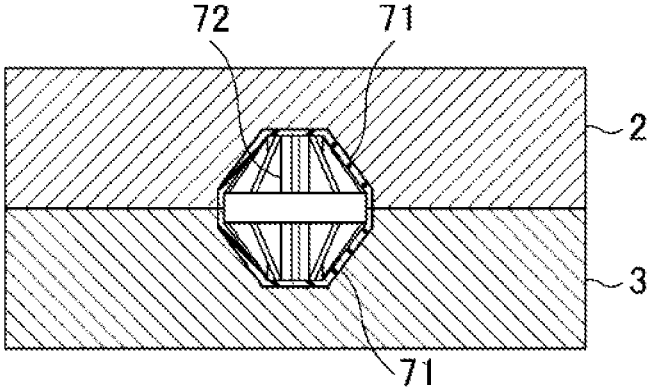

Net, the upper pavement panel 2 with another receiving member 71 embedded in and fixed to the upper pavement panel 2 in advance with the opening portion directed downward is positioned and is lowered toward the lower pavement panel 3 as illustrated in FIG. 21(C). Then, the upper pavement panel 2 is placed on the top of the lower pavement panel 3, the receiving member 71 on one side received by and fixed to the upper pavement panel 2 is fitted onto the upper half portion of the joint member 72, and the upper pavement panel 2 and the lower pavement panel 3 are thus coupled to each other with the joint member 72 as illustrated in FIG. 21(D). At this time, since the plurality of protrusions 71*a* (see FIG. 19(C)) are formed over the entire inner circumferential surface of the cylindrical portion 71C of the receiving member 71, and the plurality of protrusions 72*a* (see FIG. 20(D)) are formed over the entire outer periphery of the disk portion 71A of the joint member 72 as well, the upper pavement panel 2 and the lower pavement panel 3 are more reliably coupled to each other with the joint member 72 through the fitting between these protrusions 71*a* and 72*a*.

Advantages of the Invention

As is obvious from the above description, the multilayer precast paved road according to the present invention has the following advantages since the multilayer precast paved road is configured to include: the plurality of precast lower pavement panels 3 (including the hollow pavement panels 1) laid on the road panel 6 and the plurality of precast upper pavement panels 2 (including the end portion lower pavement panels 4) laid on the upper surfaces of the lower pavement panels 3, and is configured such that the lower pavement panels 3 and the upper pavement panels 2 are arranged in a zigzag manner, the joint members 5 (64, 72) are provided to lie between the upper and lower joining surfaces of the lower pavement panels 3 and the upper pavement panels 2, and the lower pavement panels 3 and the upper pavement panels 2 are coupled to each other through engagement or fitting between the lower pavement panels 3 and the upper pavement panels 2 achieved by the joint members 5 (64, 72).

In other words, since the multilayer precast paved road according to the present invention has a structure in which the precast lower pavement panels 3 (including the end portion lower pavement panels 4) that are two-dimensional dimensionally adjacent to each other are not coupled directly to each other similarly to the plurality of precast upper pavement panels 2 (including the hollow pavement panels 1), the plurality of upper pavement panels 2 (hollow pavement panels 1) and the plurality of lower pavement panels 3 (end portion lower pavement panels 4) forming the upper and lower layers are brought into three-dimensional contact with each other, and the upper pavement panels 2 (hollow pavement panels 1) and the plurality of lower pavement panels 3 (end portion lower pavement panels 4) that are in three-dimensional contact with each other are coupled with the joint members 5 (64, 72) at a plurality of locations, the upper pavement panels 2 (hollow pavement panels 1) that lie across the joining parts between the lower pavement panels 3 (end portion lower pavement panels 4) alleviate bending at the joining parts even if deformation occurs in the road panel 6 or the roadbed 7 supporting the pavement, and no unevenness occurs in the multilayer precast paved road.

Also, since both the upper pavement panels 2 (hollow pavement panels 1) and the lower pavement panels 3 (end portion lower pavement panels 4) are precast pavement panels and form a precast paved road with upper and lower two-layer structure, it is possible to provide a multilayer precast paved road with excellent durability that enables new construction and reconstruction such as repairing to be simply carried out regardless of weather conditions and without causing noise problems.

Moreover, since both the upper pavement panels 2 (hollow pavement panels 1) and the lower pavement panels 3 (end portion lower pavement panels 4) are precast pavement panels, it is possible to manufacture and store, in a factory, the pavement panels 1 to 4 to be used for construction in advance as scheduled and to easily and quickly address an urgent repairing construction or the like.

Also, since the construction is carried out in a construction form in which the pavement panels 1 to 4 for each layer are suspended and laid on the road panel 6 one by one using a crane, it is possible to carry out the construction without a heavy machinery dedicated for pavement used in the related art and an engineer who has learned pavement techniques.

Also, in a case where a part of the multilayer precast paved road according to the present invention is damaged, it is only necessary to remove and replace the paved panels at the damaged part to complete the repairing, and the construction including such repairing construction can thus be carried out with small noise in a short period of time.

Furthermore, since the upper pavement panels 2 (hollow pavement panels 1) are arranged in a zigzag manner with respect to the lower pavement panels 3 (end portion lower pavement panels 4) paved on the road panel 6 and the upper pavement panels 2 (hollow pavement panels 1) and the lower pavement panels 3 (end portion lower pavement panels 4) are coupled to each other with the joint members 5 (64, 72) in the multilayer precast paved road according to the present invention, no unevenness occurs.

Also, it is possible to efficiently drain rain water, for example, to provide non-contact power supply coils, and to improve electrification and magnetic susceptibility through utilization of pavement panels with various functions as the upper pavement panels 2 (hollow pavement panels 1), and it is possible to easily construct paved roads with functions that the paved roads in the related art have not had before.

In addition, if the joint members 5 (64, 72) are made of plastic or a plastic composite material, the joint members 5 (64, 72) do not get rusted, and durability of the joint members 5 (64, 72) is enhanced. Moreover, the joint members 5 (64, 72) are not loosened during utilization like bolts and nuts, and the upper pavement panels (hollow pavement panels 1) can be easily attached to and detached from the lower pavement panels 3 (end portion lower pavement panels 4), through the utilization of the joint members 5 (64, 72) for the coupling between the upper pavement panels 2 (hollow pavement panels 1) and the lower pavement panels 3 (end portion lower pavement panels 4).

Note that it is a matter of course that the application of the present invention is not limited to the embodiments described above and various modifications can be made within the scope of the technical ideas described in the claims, the specification, and the drawings.

REFERENCE SIGNS LIST

1 Hollow pavement panel
2 Upper pavement panel
3 Lower pavement panel
4 End portion lower pavement panel
5 Joint member
6 Road panel
7 Roadbed
8 Removing tool
9 Side groove
11, 110 Joint hole
12 Hollow
13 Partitioning wall
14 Water stop seal
14A Expanding portion
14B Hydrophilic portion
15 Groove portion
16 Peripheral wall
17, 170 Protruding portion
51 Body portion
52 Base portion
53 Variable locking portion with substantially umbrella shape
54 Groove portion
55 Leg portion
56 Flange portion
61, 63 Engagement projecting portion
64 Joint member
65 Wedge member
71 Receiving member
72 Joint member
81 Pressurizing portion
82 Hook
83 Catching protruding portion
84 Hollow portion
91 Non-contact power supply coil

The invention claimed is:

1. A two-layer precast paved road comprising:
a plurality of precast lower pavement panels laid on a road panel; and
a plurality of precast upper pavement panels laid on upper surfaces of the lower pavement panels,
wherein the lower pavement panels and the upper pavement panels are arranged in a zigzag manner, and
joint members are provided to lie between upper and lower joining surfaces of the lower pavement panels and the upper pavement panels, and the lower pavement panels and the upper pavement panels are coupled to each other through engagement or fitting between the lower pavement panels and the upper pavement panels achieved by the joint members,
wherein cup-shaped receiving members are embedded in and fixed to upper surfaces of the lower pavement panels and lower surfaces of the upper pavement panels, and the lower pavement panels and the upper pavement panels are coupled to each other through fitting of upper half portions and lower half portions of the joint members to the respective receiving members,
wherein the upper pavement panels and the lower pavement panels are coupled to each other with the joint members through the fitting between a plurality of protrusions formed over the entire inner peripheral surface of a cylindrical portion of the receiving members and a plurality of protrusions similarly formed over the entire outer periphery of a disk portion of the joint members, and
wherein each of the receiving members includes a bottom surface portion with a circular shape, a side surface portion with a tapered cylindrical shape extending with a diameter increasing from the bottom surface portion toward an upper side, and the cylindrical portion with a low height standing from the side surface portion in parallel and forming an opening portion peripheral edge of each of the receiving members.

2. The two-layer precast paved road according to claim 1, wherein a certain upper pavement panel of the upper pavement panels is made of a hollow pavement panel having a hollows penetrating in a road extending direction and including a water stop seal to surround an opening portion of the hollow.

3. The two-layer precast paved road according to claim 2, wherein the hollow pavement panel is made of any of plastic, carbon fiber reinforced concrete, and FRP ferroconcrete and includes a non-contact power supply coil disposed inside the hollow.

4. The two-layer precast paved road according to claim 1, wherein the upper pavement panels are made of a water-permeable material or a running noise reducing material with a porous structure or a slit surface.

5. The two-layer precast paved road according to claim 1, wherein the lower pavement panels have water stop seals on side surfaces that face the adjacent lower pavement panels.

6. A two-layer precast paved road comprising:
a plurality of precast lower pavement panels laid on a road panel; and
a plurality of precast upper pavement panels laid on upper surfaces of the lower pavement panels,
wherein the lower pavement panels and the upper pavement panels are arranged in a zigzag manner, and joint members are provided to lie between upper and lower joining surfaces of the lower pavement panels and the upper pavement panels, and the lower pavement panels and the upper pavement panels are coupled to each other through engagement or fitting between the lower pavement panels and the upper pavement panels achieved by the joint members, wherein cup-shaped receiving members are embedded in and fixed to upper surfaces of the lower pavement panels and lower surfaces of the upper pavement panels, and the lower pavement panels and the upper pavement panels are coupled to each other through fitting of upper half portions and lower half portions of the joint members to the respective receiving members, wherein the upper pavement panels and the lower pavement panels are coupled to each other with the joint members through the fitting between a plurality of protrusions formed over the entire inner peripheral surface of a cylindrical portion of the receiving members and a plurality of protrusions similarly formed over the entire outer periphery of a disk portion of the joint members, and wherein each of the joint members includes a disk portion and cylindrical portions extending vertically from the centers of upper and lower surfaces of the disk portion, and the disk portion and the upper and lower cylindrical portions are coupled to each other with a plurality of reinforcing ribs with a triangular shape.

* * * * *